US007798364B1

(12) United States Patent
Eddins et al.

(10) Patent No.: US 7,798,364 B1
(45) Date of Patent: Sep. 21, 2010

(54) TOY WATER GUN FOR DISCHARGING AND MIXING MULTIPLE LIQUIDS

(75) Inventors: Fred D. Eddins, Mapleville, RI (US); Linwood E. Doane, Jr., Johnston, RI (US); Amanda M. Bligh, Attleboro, MA (US)

(73) Assignee: Hasbro, Inc., Pawtucket, RI (US)

( * ) Notice: Subject to any disclaimer, the term of this patent is extended or adjusted under 35 U.S.C. 154(b) by 1241 days.

(21) Appl. No.: 11/315,580

(22) Filed: Dec. 22, 2005

(51) Int. Cl.

| | |
|---|---|
| ***A63H 3/18*** | (2006.01) |
| ***A63H 33/30*** | (2006.01) |
| ***A62C 13/62*** | (2006.01) |
| ***F41B 11/00*** | (2006.01) |
| ***F41A 33/00*** | (2006.01) |

(52) U.S. Cl. ..... 222/79; 222/400.5; 222/192; 222/135; 239/306; 239/416.5; 239/419; 446/475; 446/473; 124/63; 124/75; 42/54

(58) Field of Classification Search ..... 222/78, 222/79, 400.8, 400.5, 401, 113, 175, 608, 222/192, 132, 135, 136, 137, 145.3, 1; 446/475, 446/473, 400, 401; 124/59, 63, 75, 56; 42/54; 239/419, 423, 424, 333, 306, 307, 304, 416.1, 239/418, 416.4, 416.5

See application file for complete search history.

(56) References Cited

U.S. PATENT DOCUMENTS

| | | | | |
|---|---|---|---|---|
| 3,197,070 | A | 7/1965 | Pearl et al. | 222/79 |
| 4,214,674 | A | 7/1980 | Jones et al. | 222/79 |
| 4,902,281 | A * | 2/1990 | Avoy | 604/191 |
| 5,005,736 | A * | 4/1991 | Portas | 222/135 |
| D336,939 | S | 6/1993 | Salmon et al. | D21/147 |
| 5,238,149 | A | 8/1993 | Johnson et al. | 222/79 |
| D341,396 | S | 11/1993 | Salmon et al. | D21/147 |
| 5,292,032 | A * | 3/1994 | Johnson et al. | 222/79 |
| 5,305,919 | A * | 4/1994 | Johnson et al. | 222/79 |
| 5,322,191 | A * | 6/1994 | Johnson et al. | 222/79 |
| 5,622,159 | A | 4/1997 | Liu et al. | 124/66 |
| 5,678,730 | A | 10/1997 | Fabek et al. | 222/78 |
| 5,758,800 | A * | 6/1998 | D'Andrade | 222/79 |
| 5,826,750 | A * | 10/1998 | Johnson | 222/79 |
| 5,878,914 | A * | 3/1999 | Johnson | 222/79 |
| 6,203,397 | B1 | 3/2001 | Applewhite et al. | 446/475 |
| 6,892,902 | B2 * | 5/2005 | Hornsby et al. | 222/79 |
| 7,025,228 | B2 * | 4/2006 | Cuisinier | 222/79 |
| 7,131,557 | B2 * | 11/2006 | Zimmerman et al. | 222/79 |

* cited by examiner

*Primary Examiner*—Kevin P Shaver
*Assistant Examiner*—Stephanie E Williams
(74) *Attorney, Agent, or Firm*—Miller, Matthias & Hull

(57) ABSTRACT

The present invention relates generally to a toy water gun and, more particularly, to a pressurized toy water gun having a mixing nozzle or nozzles for simultaneously discharging and mixing two or more liquids after they pass through the mixing nozzle. In one embodiment, the toy gun may include separate tanks or reservoirs for storing the liquids, and separate nozzles for receiving and discharging the liquids in discharged streams of liquid. The toy gun may further include a pressurization mechanism in fluid communication with the tanks and the nozzles to provide pressure to cause the liquids to be discharged from the nozzles in the discharged streams of liquid. The nozzles may be oriented relative to each other such that the discharged streams engage each other after being discharged from the outlets of the nozzles to mix the liquids.

32 Claims, 14 Drawing Sheets

TOY WATER GUN FOR DISCHARGING AND MIXING MULTIPLE LIQUIDS

BACKGROUND OF THE INVENTION

The present invention relates generally to a toy water gun and, more particularly, to a pressurized toy water gun having a mixing nozzle or nozzles for simultaneously discharging and mixing two or more liquids after they pass through the mixing nozzle.

Pressurized squirt guns that eject water and other liquids or semi-solid materials from a pressurized reservoir are generally known in the art. For example, U.S. Pat. No. 5,238,149 to Johnson et al. discloses a toy water gun which is operated by selectively releasing water from a pressurized water reservoir. The toy water gun has a manually operated pump incorporated in the design. As the pump is cycled, water and/or air are drawn from at least one water storage reservoir. One drawn, the water and/or air are forced into at least one pressure tank. As the amount of water and/or air forced into the pressure tank increases, the pressure the air displaced by the water within the pressure tank increases. The pressure of the air on the water within the pressure tank increases with each cycle of the pump, until the pump can no longer overcome the pressure of the air on the water within the pressure tank. The pressurized air and water within the pressure tank have an avenue of release that is regulated by the trigger mechanism which has a safety pressure release within its design. When no force is applied to the trigger, the pressurized water and air held within the toy water gun with no means of release. When force is applied to the trigger, the heavier water is first released from the bottom of the pressurized tank and is channeled through a narrow nozzle. The number of storage reservoirs and pressure tanks combine totals at least three.

U.S. Pat. No. 5,622,159 to Liu et al. discloses a toy weapon firing a shapeless solid charge and including a reciprocating air pump and an extruder including a reservoir of the shapeless flowable solid material. A tubular nozzle member is mounted on the outlet end of the air pump and includes a transversely extending nipple providing a fluid coupling with the outlet of the extruder. A portion of the housing is configured to form a hand grip while a separate hand grip is coupled with the air cup piston to permit reciprocation of the air pump piston by reciprocating the hand grip portions toward one another and away from one another. The extruder may be operated separately from the air pump or linked within the air pump for simultaneous operation to feed a charge of the shapeless flowable solid material into the nozzle member before or while the air pump is reciprocated.

U.S. Pat. No. 5,678,730 to Fabek et al. discloses an amusement device for selectively discharging a pressurized medium from a users palm, in effect, enabling a person to mimic Spiderman. The amusement device includes a hand strap which is adapted to be positioned about the palm area of a user, a canister holder which is connected to the hand strap, and a canister of stringy web-like material. The amusement device allows a user to dispense the web-like material from the users palm.

Further, U.S. Pat. No. 6,203,397 to Applewhite et al. discloses a toy gun having a housing, a barrel, a trigger, and a manual air pump. The manual air pump is coupled to both a water pressure tank and an air pressure chamber. The water pressure tank is coupled to a quick release water nozzle or valve. The air pressure chamber is coupled to a quick release air valve. The trigger is coupled to a moveable switch which selectively engages either the quick release water nozzle to release a stream of water with actuation of the trigger or the quick release air valve to release a burst of compressed air with actuation of the trigger.

SUMMARY OF THE INVENTION

In one aspect, the invention is directed to a toy gun for discharging and mixing a first liquid and a second liquid. The toy gun may include a first tank configured to receive the first liquid, a second tank configured to receive the second liquid, a first nozzle having a first inlet in fluid communication with the first tank and a first outlet, and a second nozzle having a second inlet in fluid communication with second tank and a second outlet. The toy gun may further include a pressurization mechanism in fluid communication with the first and the second tanks and the first and the second nozzles, wherein the pressurization mechanism may provide pressure to cause the first liquid from the first tank to be discharged from the first outlet of the first nozzle in a first discharge stream, and to cause the second liquid from the second tank to be discharged from the second outlet of the second nozzle in a second discharge stream. The first nozzle and the second nozzle may be oriented relative to each other such that the first discharge stream and the second discharge stream engage each other after being discharged from the first outlet and second outlet, respectively.

In another aspect, the invention is directed to a mixing nozzle for a toy gun for discharging and mixing a first liquid and a second liquid. The mixing nozzle may include a first nozzle having a first inlet and a first outlet, wherein the first inlet may be configured to receive the first liquid from a pressurized source of the first liquid, and the first outlet may be configured to discharge the pressurized first liquid in a first discharge stream. The mixing nozzle may further include a second nozzle having a second inlet and a second outlet, wherein the second inlet may be configured to receive the second liquid from a pressurized source of the second liquid, and the second outlet may be configured to discharge the pressurized second liquid in a second discharge stream. The first nozzle and the second nozzle may be oriented relative to each other such that the first discharge stream and the second discharge stream engage each other after being discharged from the first outlet and second outlet, respectively.

In a further aspect, the invention is directed to a toy gun for discharging and mixing a first liquid and a second liquid, and for discharging a third liquid. The toy gun may include a first tank configured to receive the first liquid, a second tank configured to receive the second liquid, a first nozzle having a first inlet in fluid communication with the first tank and a first outlet, and a second nozzle having a second inlet in fluid communication with second tank and a second outlet. The toy gun may further include a first pressurization mechanism in fluid communication with the first and the second tanks and the first and the second nozzles, wherein the first pressurization mechanism may provide pressure to cause the first liquid from the first tank to be discharged from the first outlet of the first nozzle in a first discharge stream, and to cause the second liquid from the second tank to be discharged from the second outlet of the second nozzle in a second discharge stream. The first nozzle and the second nozzle may be oriented relative to each other such that the first discharge stream and the second discharge stream engage each other after being discharged from the first outlet and second outlet, respectively. The toy gun may also include a third tank configured to receive the third liquid, a third nozzle having a third inlet in fluid communication with the third tank and a third outlet, and a second pressurization mechanism in fluid communication with the third tank and the third nozzle. The second pressurization mechanism may provide pressure to cause the third liquid from the third tank to be discharged from the third outlet of the third nozzle in a third discharge stream.

In a still further aspect, the invention is directed to a method for discharging and mixing a first liquid and a second liquid from a toy gun. The method may include providing a first nozzle for discharging the first liquid and a second nozzle for discharging the second liquid, and aligning the first nozzle and the second nozzle such that a discharged stream of the first liquid from the first nozzle and a discharged stream of the second liquid from the second nozzle engage each other after being discharged from the first nozzle and second nozzle, respectively. The method may further include storing a quantity of the first liquid and a quantity of the second liquid in the toy gun, and simultaneously supplying the stored first liquid to the first nozzle and the stored second liquid to the second nozzle under pressure for discharge from the first and second nozzles, respectively, as the discharged streams of liquid.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
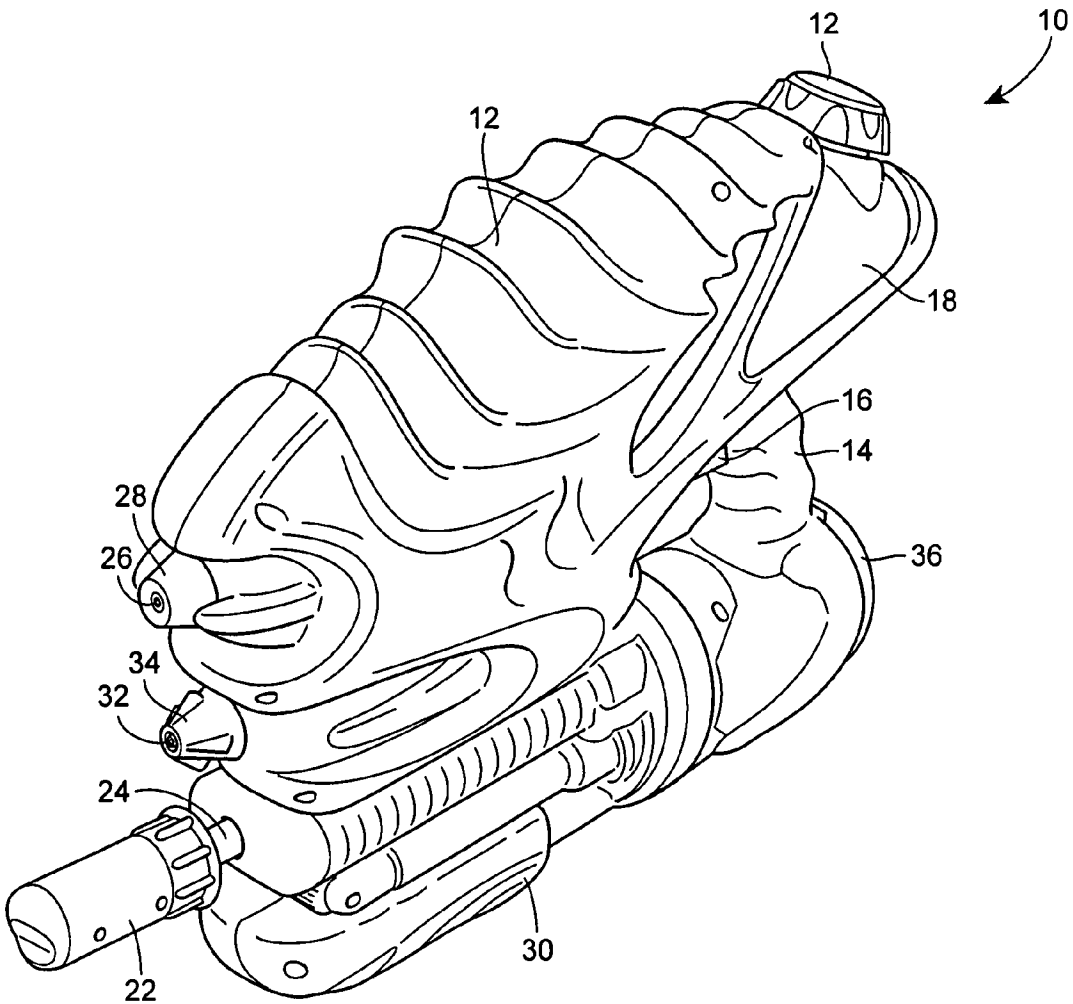
FIG. 1 is a perspective view of a toy water gun having a spray nozzle and a mixing nozzle in accordance with the invention.
Figure 2:
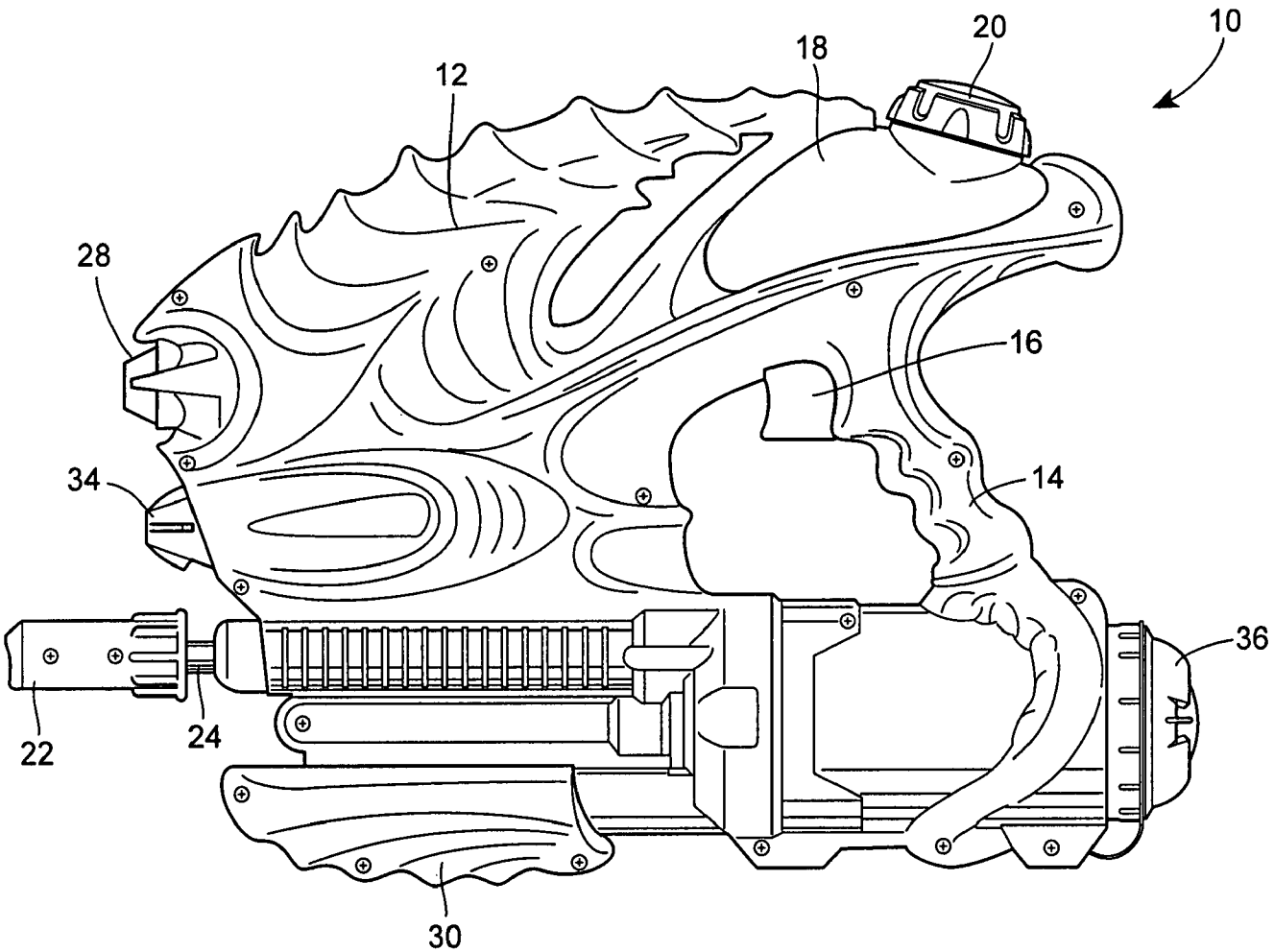
FIG. 2 is a side view of the toy water gun of FIG. 1.
Figure 3:
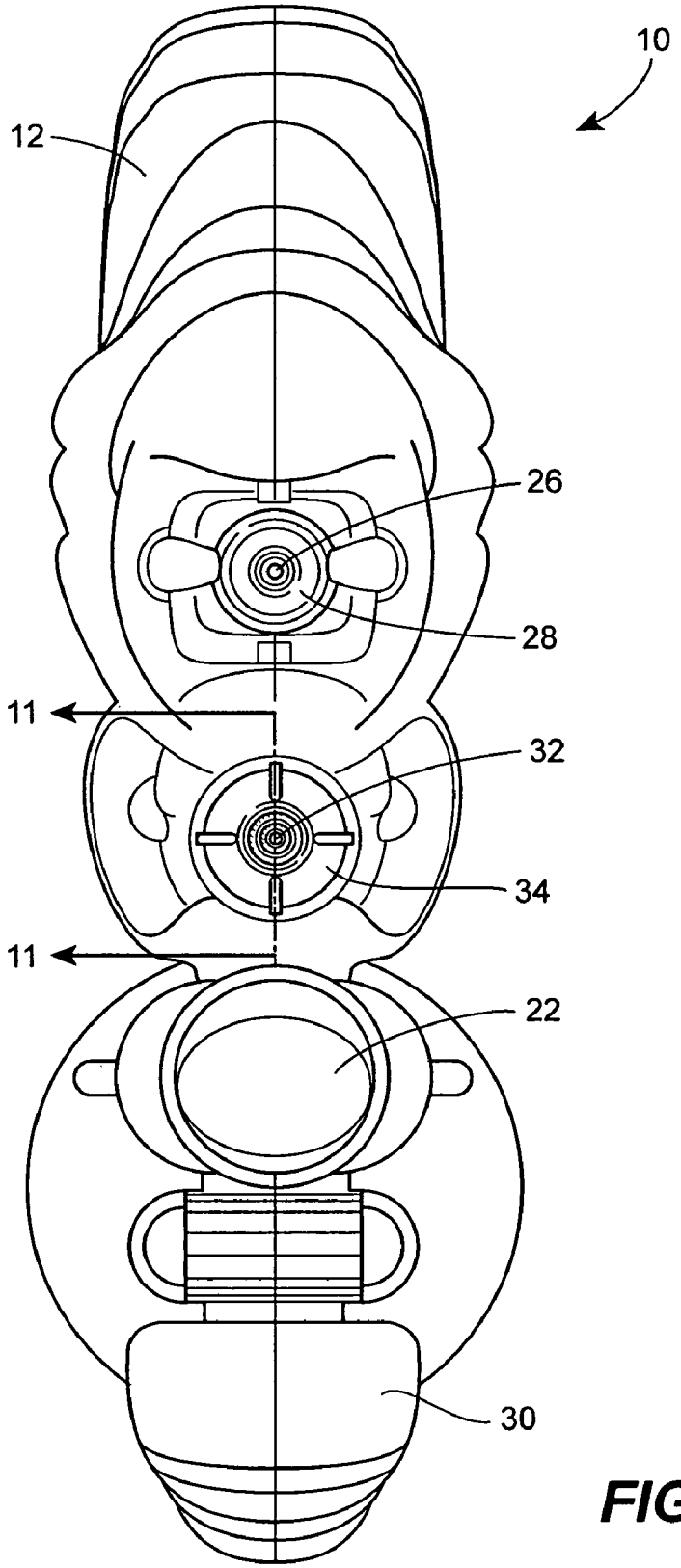
FIG. 3 is a front view of the toy water gun of FIG. 1.

FIGS. 1-3 illustrate perspective, side and front views, respectively, of an embodiment of a pressurized toy gun 10 in accordance with the present invention. The toy gun 10 includes an outer housing 12 having a grip 14 configured to be grasped by a user with either hand and to position the user's index finger proximate a moveable trigger 16 that may be moved rearward to cause the toy gun 10 to discharge a stream of liquid. The toy gun 10 may be configured with multiple discharge mechanisms for discharging multiple liquids from different locations of the toy gun 10. A first discharge mechanism of the toy gun 10 may include the trigger 16, a tank or reservoir 18 that may hold a quantity of liquid to be discharged by the toy gun 10, with the liquid being deposited into the reservoir 18 when a fill cap 20 is removed, and a first pump handle 22 that may be cycled by the user to pressurize the liquid stored in the reservoir 18. The first pump handle 22 may be attached to a first stem 24 that is in turn attached to a piston within a cylinder (not shown) that is configured to compress the air within the reservoir 18 and pressurize the first discharge mechanism when the first pump handle 22 is moved from an extended position to the illustrated inward position as described more fully below. The first discharge mechanism may further include a spray nozzle 26 extending through an opening in a spray nozzle housing 28 and through which the pressurized liquid stored in the reservoir 18 may be discharged when the trigger 16 is pulled rearward by the user.

A second discharge mechanism of the toy gun 10 may be configured to simultaneously discharge and mix two liquids stored therein. In one embodiment, the two discharged liquids may be compounds that may mix as they are discharged and form a gel that sprays away from the toy gun 10 in a string. The second discharge mechanism may include a second pump handle 30, a dual-tank canister (not shown) disposed within the housing 12 and holding each of the liquids in a separate tank within the canister, and a mixing nozzle 32 extending through an opening in a mixing nozzle housing 34 and through which the pressurized liquids from the tanks of the canister may be discharged. In a manner to be described more fully below, the second discharge mechanism may be primed when the second pump handle 30 moves forwardly toward an extended position, and the liquids may be discharged through the mixing nozzle 32 when the second pump handle 30 moves rearward toward its inward position, with the mixing nozzle 32 being configured to mix the two liquids as they are discharged.

Figure 4:
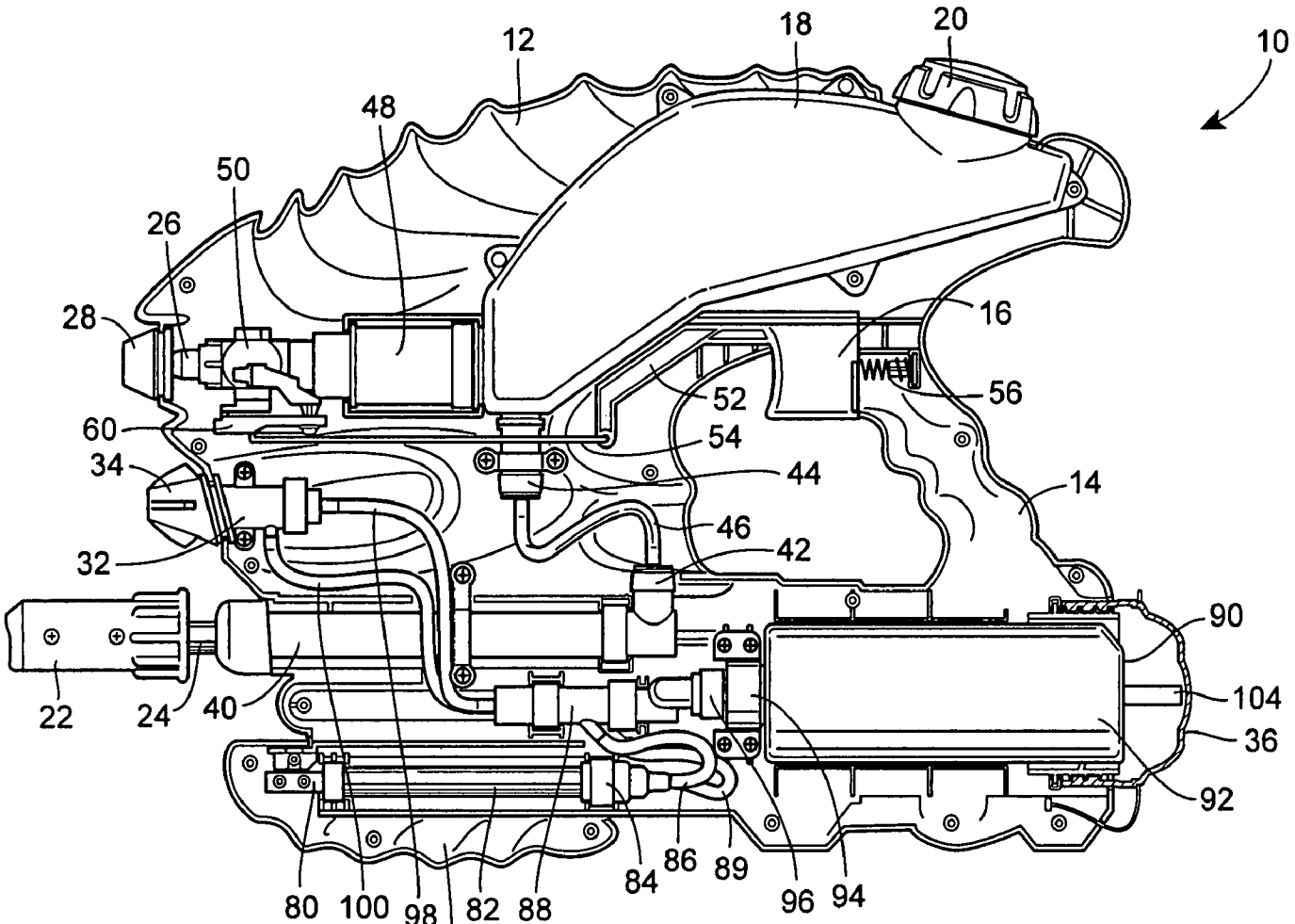
FIG. 4 is a side view of the toy water gun of FIG. 1 with one side of the housing removed to expose the internal components.

FIG. 4 illustrates the toy gun 10 with the facing side of the housing 12 removed to reveal the interior components of the toy gun 10. As discussed above, the first discharged mechanism includes the reservoir 18, the first handle 22, the first stem 24, and the spray nozzle 26. The first stem 24 is connected to a piston (not shown) slidably disposed within a first cylinder 40 such that the first handle 22 may move outwardly in an expansion stroke and inwardly in a compression stroke to pressurize the first discharge mechanism. The first cylinder 40 may include a connector 42, and the reservoir 18 may include a connector 44 having a conduit 46 disposed therebetween to place the first cylinder 40 in fluid communication with the reservoir 18. The connectors 42, 44 may be configured to retentively and sealingly engage the conduit 46 to provide an air-tight and water-tight seal such that air and liquid may not leak at the points of connection of the conduit 46 with the connectors 42, 44. Additionally, in order to maintain pressurization within the reservoir 18 when the first handle 22 is cycled to pressurize the first discharge mechanism, one of the connectors 42, 44 may include a one-way valve (not shown) that may allow air to pass from the first cylinder 40 to the reservoir 18 when the first handle 22 moves toward the inward position in a compression stroke, and may prevent air and liquid from flowing in the reverse direction from the reservoir 18 and into the first cylinder 40.

The reservoir 18 may also be in fluid communication with the spray nozzle 26 in a manner that allows liquid in the reservoir 18 to be selectively discharged through the spray nozzle 26 after the first discharge mechanism has been pressurized. An opening of the reservoir 18 may be in fluid communication with an intermediate channel 48, which in turn is placed in fluid communication with the spray nozzle 26 by a snap action ball valve 50. The snap action ball valve 50 may be configured with a normal closed position preventing liquid and air from the reservoir 18 from being discharged through the spray nozzle 26, and an opened position allowing the liquid and air to flow from the reservoir 18 through the intermediate channel 48 and the ball valve 50, and out through the spray nozzle 26. The ball valve 50 may be operatively connected to the trigger 16 such that the ball valve 50 moves from the normal closed position to the open position when the trigger 16 is pulled rearwardly by the user. The trigger 16 may include a connector arm 52 coupled to a link 54 which in turn is coupled to a trip assembly 60 of the ball valve 50 that may be configured to cause the ball valve 50 to move from the normal closed position to the open position with a snap action that results in a burst of the liquid from the reservoir 18 being discharged through the spray nozzle 26. In order to insure that the trigger 16 is disposed in its normal forward position, and correspondingly the ball valve 50 is disposed in its normal closed position, a spring 56 may be disposed between an inner surface of the housing 12 and the trigger 16 to bias the trigger 16 towards its normal position when a user is not applying a force to pull the trigger 16 rearward.

Figure 5:
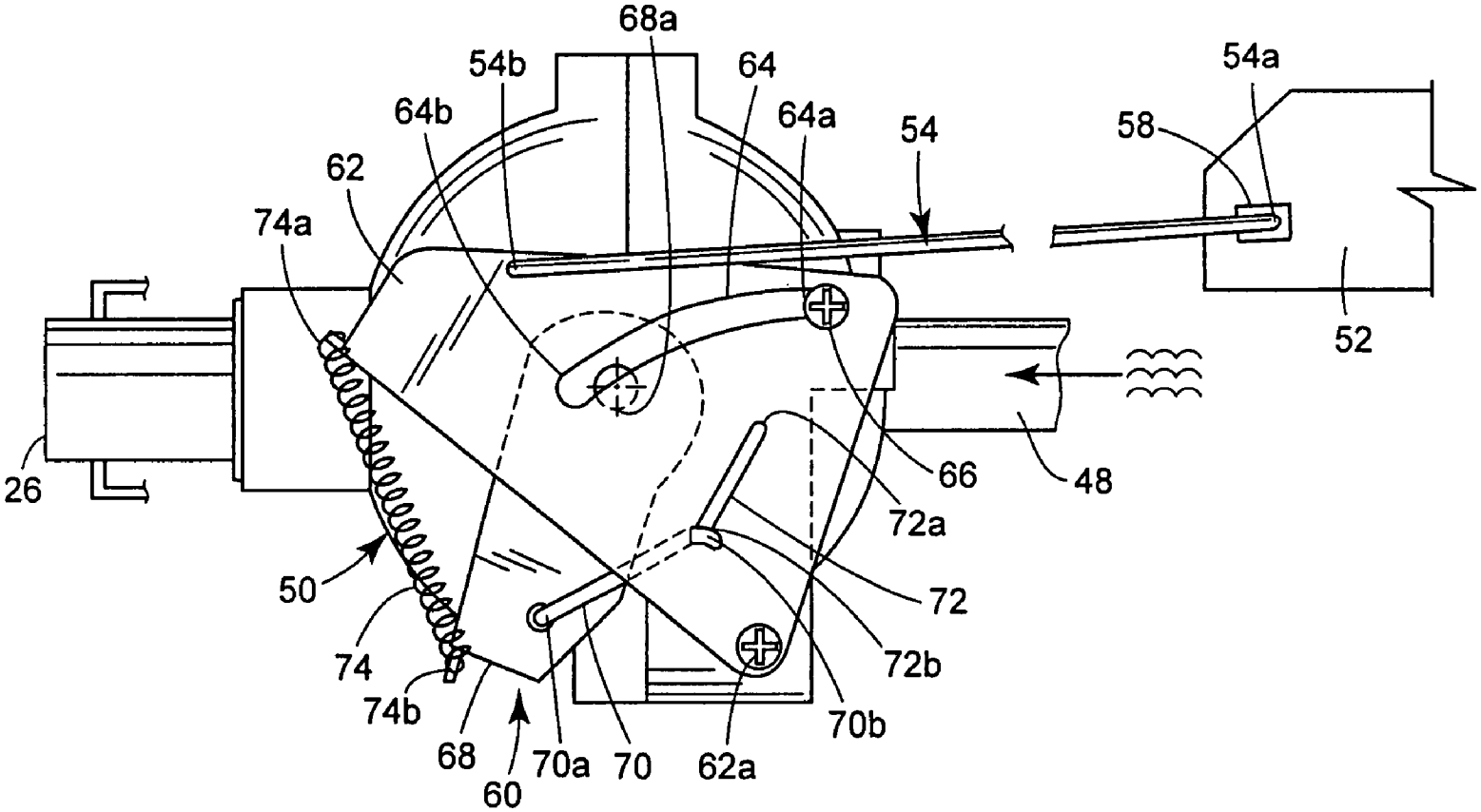
FIG. 5 is an enlarged fragmentary plan view of a snap action ball valve and trip assembly illustrated in a first position.
Figure 6:
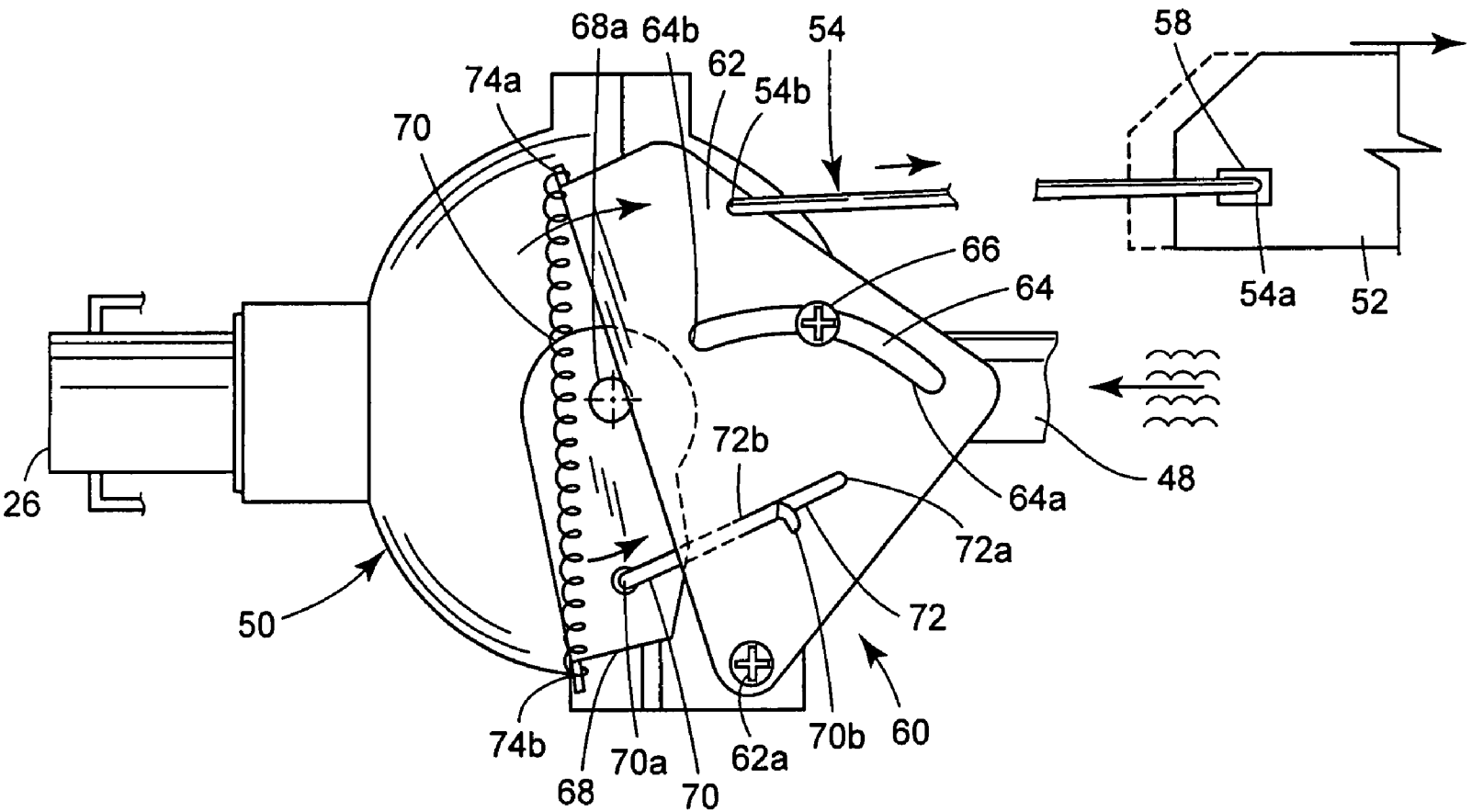
FIG. 6 is an enlarged fragmentary plan view similar to FIG. 5 and illustrating the trip assembly in a second position.
Figure 7:
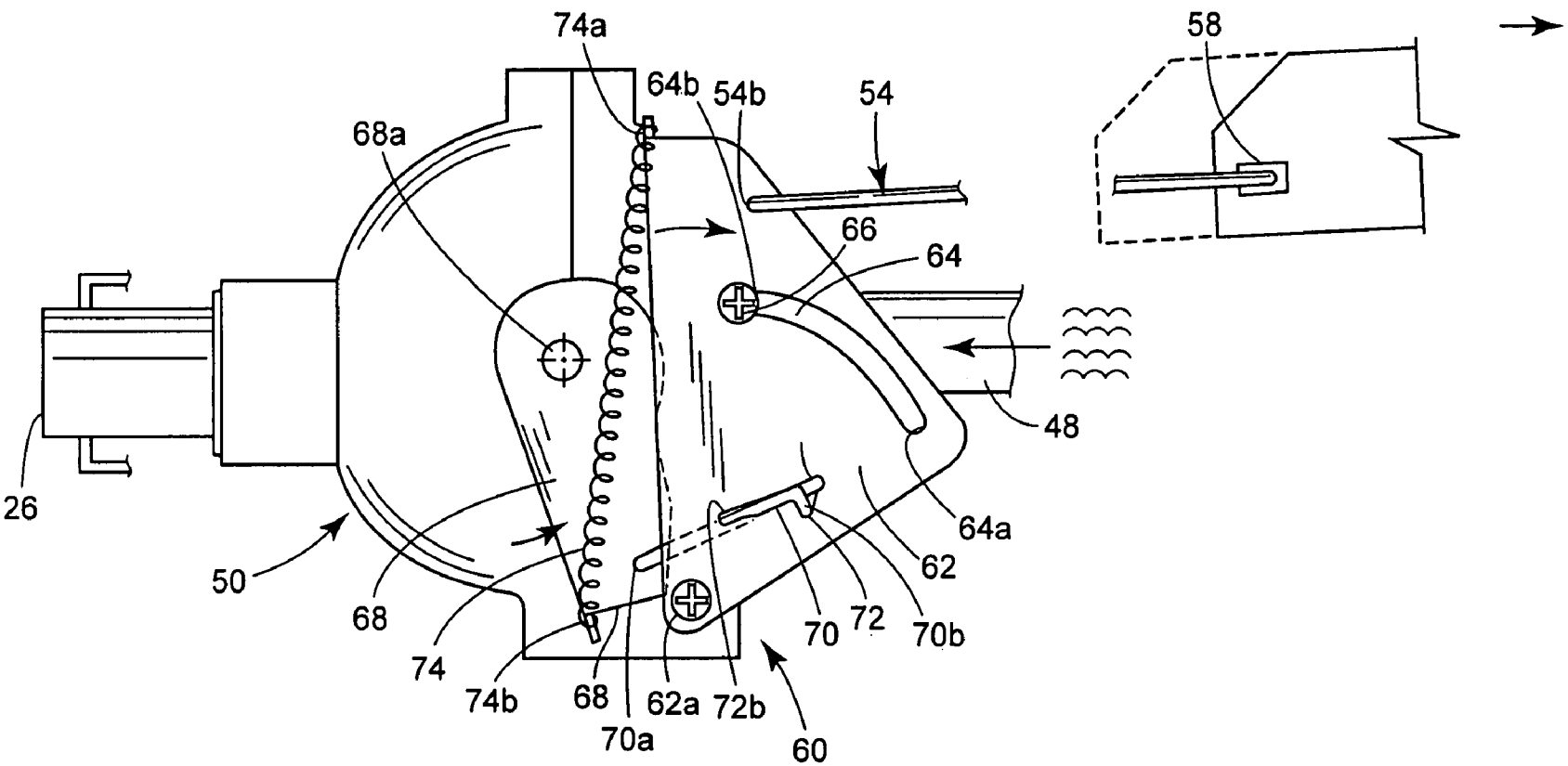
FIG. 7 is an enlarged fragmentary plan view similar to FIGS. 5 and 6 and illustrating the trip assembly in a third position.
Figure 8:
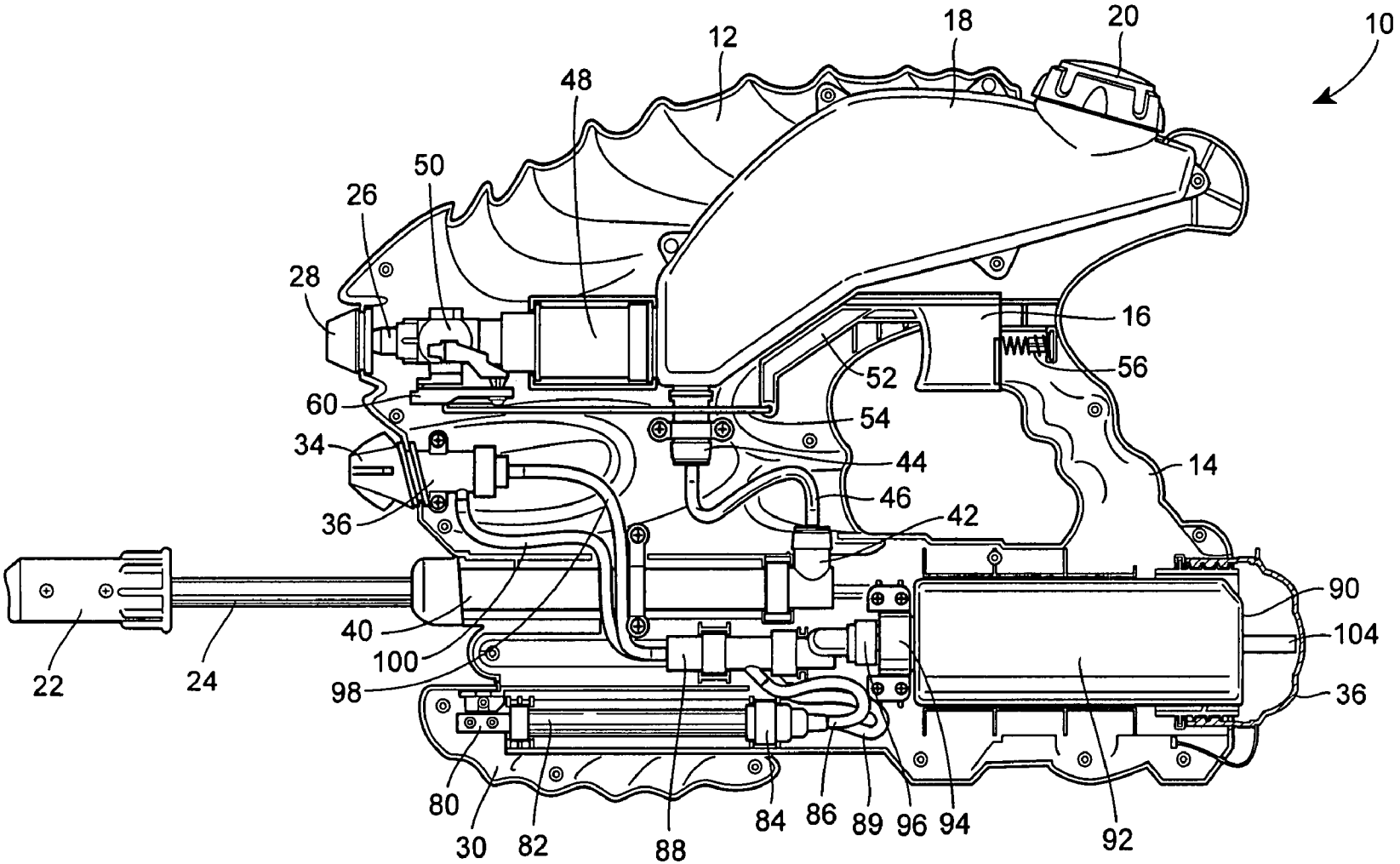
FIG. 8 is a side view of the toy water gun as shown in FIG. 4 with a first pump handle in an extended position.

FIGS. 5-7 illustrate one embodiment of the ball valve 50 and a corresponding snap action trip assembly 60 that may be used in the toy gun 10, with the trip assembly 60 being operatively connected to the arm 52 via the link 54 connected at hole 58. The trip assembly 60 controls the actuation of the ball valve 50 and enables the water to be discharged from the spray nozzle 26 in a burst when the ball valve 50 snaps to the open position. The trip assembly 60 includes a pivot plate 62 which pivots about a pivot point 62*a*. The upper end 54*b* of the link 54 is attached to the pivot plate 62. The pivot plate 62 includes a slot 64 having a pair of ends 64*a* and 64*b*, and a stop screw 66 is mounted so as to extend through the slot 64 and remain stationary relative to the housing of the ball valve 50. A lever 68 is operatively connected to the ball disposed within the ball valve 50, and the lever 68 is pivotable about a pivot point 68*a*. The lever 68 may be connected to the pivot plate 62 by a link arm 70 which fits within a slot 72 in the pivot plate 62. The slot 72 includes a pair of ends 72*a* and 72*b*. A spring 74 is connected to the pivot plate 62 at 74*a* and to the lever 68 at 74*b*. When the plate 62 and the lever 68 are positioned as shown in FIG. 5, the ball valve 50 is closed such that no water will be ejected from the spray nozzle 26.

Referring now to FIG. 6, when the arm 52 moves rearwardly as the trigger 16 is pulled from an initial position shown in FIG. 5 to an intermediate position of FIG. 6, the link 54 pulls on the pivot plate 62, causing the pivot plate 62 to shift in a generally clockwise direction about the pivot 62*a*. In the process, the link arm 70 pulls the lever, causing the lever 68 to rotate in a generally counterclockwise direction about the pivot point 68*a*, thus opening the ball valve 50 such that water may be ejected in a burst from the spray nozzle 26.

Referring now to FIG. 6, when the arm 52 is displaced sufficiently rearward to a position as shown in FIG. 6, the pivot plate 62 may pivot sufficiently far that the stop screw 66 comes into contact with the end 64*b* of the slot 64. Eventually, the spring 74 will pass the pivot point 68*a*, which causes the spring 74 to apply a further biasing force to the lever 68, thereby causing the lever 68 to rotate more rapidly in the counter-clockwise direction about the pivot point 68*a*. The link arm 70 may come into contact with the end 72*a* of the slot 72, thus limiting the rotational movement of the lever 68. The ball valve 50 may be arranged such that the ball valve 50 is fully opened when the lever 68 is rotated far enough.

Forward movement of the arm 52 due to the biasing of the trigger 16 toward the normal position by the spring 56 will permit the trip assembly 60 to return to the position of FIG. 5. Without the rearward force of the user pulling the trigger 16, the force of the spring 74 may rotate the pivot plate 62 in the counterclockwise direction in FIG. 7. Once the direction of the force of the spring 74 moves past the pivot point 68*a* of the lever 68, the lever 68 rotates rapidly in the clockwise direction to snap the ball valve 50 shut. Once the ball valve 50 is shut and the trip assembly 60 is in the normal position, the liquid in the reservoir 18 may again be pressurized by pumping the first handle 22 in preparation for discharging a subsequent burst of water from the spray nozzle 26.

Consequently, in accordance with the disclosed example, the trip assembly 60 serves to define a first normal position shown in FIG. 5 (in which the ball valve 50 is closed), and a second open position shown in FIG. 7 (in which the ball valve 50 is in a fully open position), and to cause the ball valve 50 to move through intermediate positions (FIG. 6) therebetween. Other configurations may be chosen, including by way of example rather than limitation, a closed position and one or more open positions for the ball valve 50. Additional description of the snap action trip assembly 60 can be found in U.S. Pat. No. 6,631,830, entitled "Snap Action Ball Valve Assembly and Liquid Dispenser Using the Same," the entire disclosure of which is incorporated herein by reference.

The pressurization and discharge of liquid from the first discharge mechanism will now be discussed with reference to FIGS. 4-8. To pressurize the first discharge, mechanism, the first pump handle 22 is pulled outwardly away from the housing 12 toward the position shown in FIG. 8, and then pushed inwardly towards the housing 12 to the position shown in FIG. 4 such that the piston within the first cylinder 40 compresses the air in this first cylinder 40 and forces the air passed the one-way valve in the connector 42 or 44, through the conduit 46 and into the reservoir 18. The piston within the first cylinder 40 may be configured such that air may be allowed to pass around or through the piston and into the first cylinder 40 when the first pump handle 22 is pulled outwardly. The one-way valve in the connector 42 or 44 may close under the pressure of the air and liquid to prevent pressurized liquid and air from the reservoir 18 from flowing into the first cylinder 40 under normal conditions and when the first pump handle 22 is pulled outwardly. The first pump handle 22 may be cycled multiple times by the user to obtain a desired amount of pressure within the first discharge mechanism. Once the first discharge mechanism is pressurized to the desired level, the user may discharge the pressurized liquid by pulling the trigger 16 rearward against the force of the spring 56. As the trigger 16 moves rearward, the link 54 acts on the trip assembly 60 in the manner described above, with the trip assembly 60 ultimately causing the ball valve 50 to snap open and allow the pressurized liquid within the reservoir 18 to pass through the intermediate channel 48 and ball valve 50, and to be discharged in a burst from the spray nozzle 26. When the trigger 16 is released, the spring 56 causes the trigger 16 and trip assembly 16 to move back to their normal positions with the ball valve 50 closed. Once the ball valve 50 is closed, additional liquid may be added to the reservoir 18 by removing the fill cap 20, and the first discharge mechanism may be pressurized by again cycling the first pump handle 22 to achieve a desired internal pressure.

The second discharge mechanism including the mixing nozzle 32 will now be discussed initially with reference to FIG. 4. As previously discussed, the second discharge mechanism stores two liquids, and simultaneously discharges and mixes the liquids at the mixing nozzle 32. Until the liquids are discharged from the mixing nozzle 32, the liquids remain separated within the second discharge mechanism and pass through separate but parallel fluid flow paths to arrive at the mixing nozzle 32. Consequently, some structures visible in FIG. 4 relating to the fluid flow path of one of the liquids have corresponding structures disposed on the opposite side for the fluid flow path the second liquid, and such corresponding structures will be discussed as necessary.

The second pump handle 30 may be connected to a second stem having a piston (not shown) connected to the opposite end and disposed and slideable within a second cylinder 82. An additional stem and piston may be attached to the second pump handle 30 and may be disposed in a corresponding second cylinder 82 disposed on the opposite side of the visible second cylinder 82. The visible second cylinder 82 may have a connector disposed at one end sealingly engaging one end of a conduit 86, with the opposite end of the conduit 86 being attached at an opening to an intermediate reservoir 88. The connector 84 and opening of the intermediate reservoir 88 may be configured to retentively and sealingly engage the conduit 86 with air-tight and water-tight seals and place the second cylinder 82 in fluid communication with the intermediate reservoir 88. In a similar manner, a second conduit 89 may connect a connector 84 of the additional second cylinder 82 to an additional intermediate reservoir 88.

The liquids to be discharged from the mixing nozzle 32 may be stored in a canister 90 that may be inserted into and removed from the housing 12 in a manner described more fully below. The canister 90 may include a reservoir or tank 92 having an endcap 94 configured to be engaged by a connector 96 of the intermediate reservoir 88 to place the tank 92 in fluid communication with the intermediate reservoir 88. The connector 96 may include a one-way valve (not shown) that may allow liquid to flow from the tank 92 into the intermediate reservoir 88, and prevent flow back into the tank 92. The intermediate reservoir 88 may further include an outlet configured to sealingly engage one end of a conduit 98, with the other end of the conduit 98 being sealingly engaged by a first inlet of the mixing nozzle 32. The second cylinder 82, conduit 86, intermediate reservoir 88, tank 92 and conduit 98 form the fluid flow path for one of the liquids from the canister 90 to the mixing nozzle 32. The fluid flow path for the second liquid is composed of the corresponding second cylinder 82 and intermediate reservoir 88 connected by the conduit 89, a second reservoir or tank 92 having an end cap 94 coupled to a connector 96 of the second intermediate reservoir 88, and a conduit 100 connecting an outlet of the second intermediate reservoir 88 to a second inlet of the mixing nozzle 32.

Figure 9:
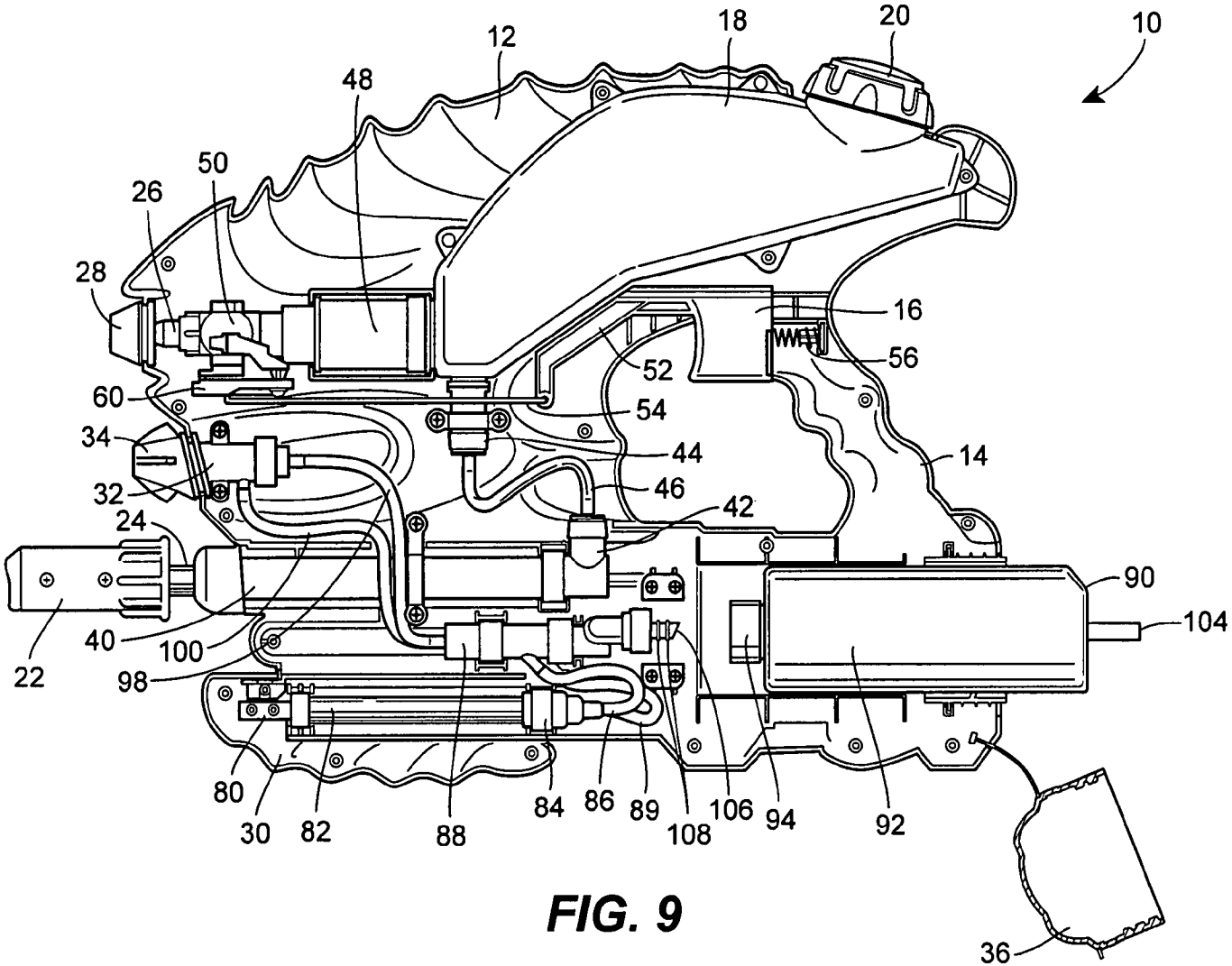
FIG. 9 is a side view of the toy water gun as illustrated in FIG. 4 with a canister cover detached and a canister partially removed from the toy water gun.
Figure 10:
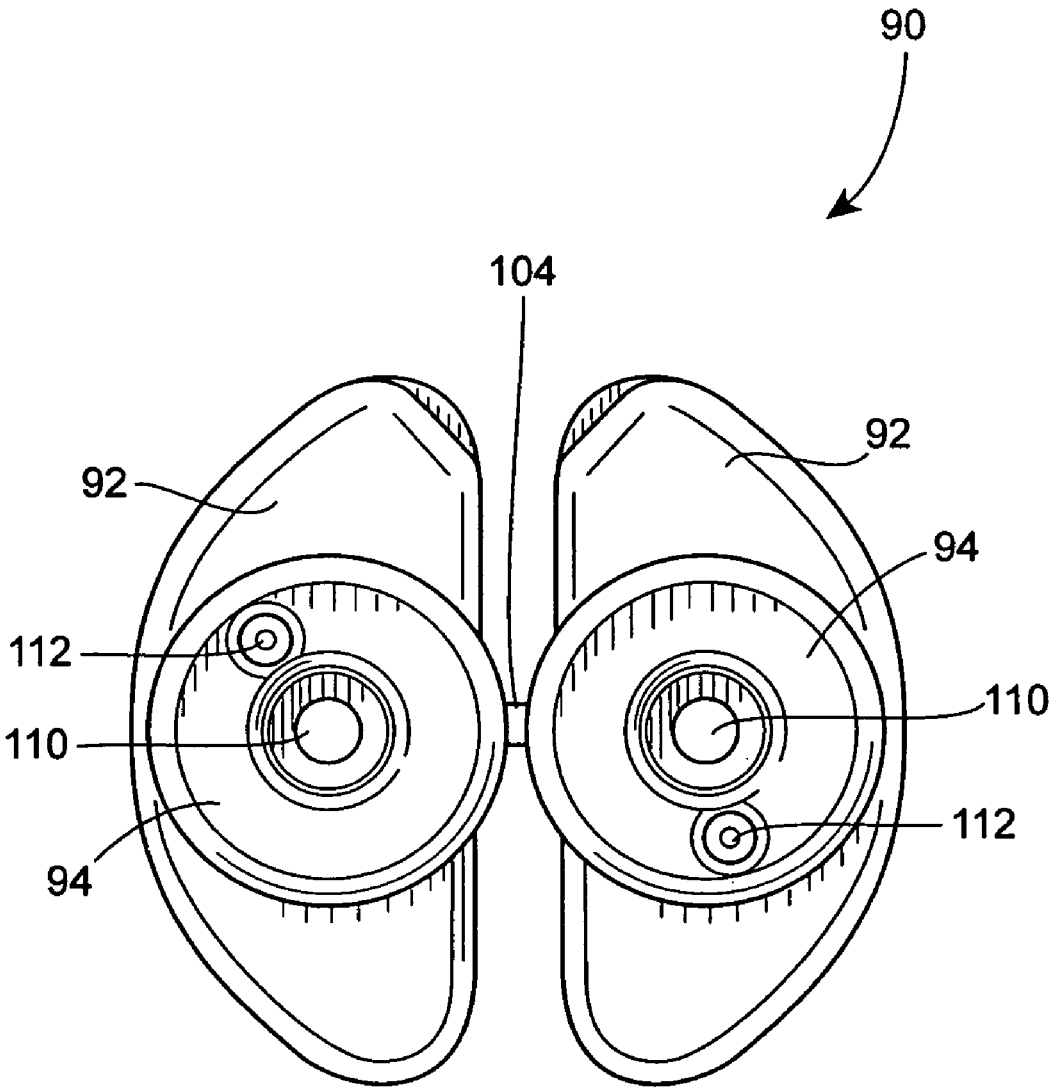
FIG. 10 is a front view of the canister of the toy water gun of FIG. 1.

As discussed above, the canister 90 may be inserted into and removed from the housing 12. Referring to FIG. 9, the interior of the housing 12 may be accessed by unscrewing the cover 36 from the rear of the housing 12. Once the cover 36 is removed, a user may grasp a grip 104 and pull the canister 90 rearwardly. As the canister 90 moves rearwardly, the end caps 94 detach from inlet stems 106 of the connectors 96. The inlet stems 106 may each have one or more O-rings 108 disposed thereon and configured to engage an inner surface of the corresponding end cap 94 to provide an air-tight and water-tight seal between the tank 92 and the intermediate reservoir 88. Referring to FIG. 10, a front view of the canister 90 further illustrates the components of the canister 90 for both fluid flow paths. The end caps 94 of the tanks 90 include an opening configured to receive the corresponding inlet stems 106 and to engage the O-rings 108 to form air-tight and water-tight seals. Each end cap 94 may further include an opening 110 having a one-way vent 112 disposed therein that may allow air to be drawn into the tank 92 when the liquid in the tank 92 is drawn out of the tank 92 as the second discharge mechanism is primed in a manner described more fully below, and to prevent the liquid from exiting the tank 92 through the vent 112. The grip 104 may attach the tanks 92 side-by-side to allow the canister 90 to be inserted into the housing 12.

Figure 11:
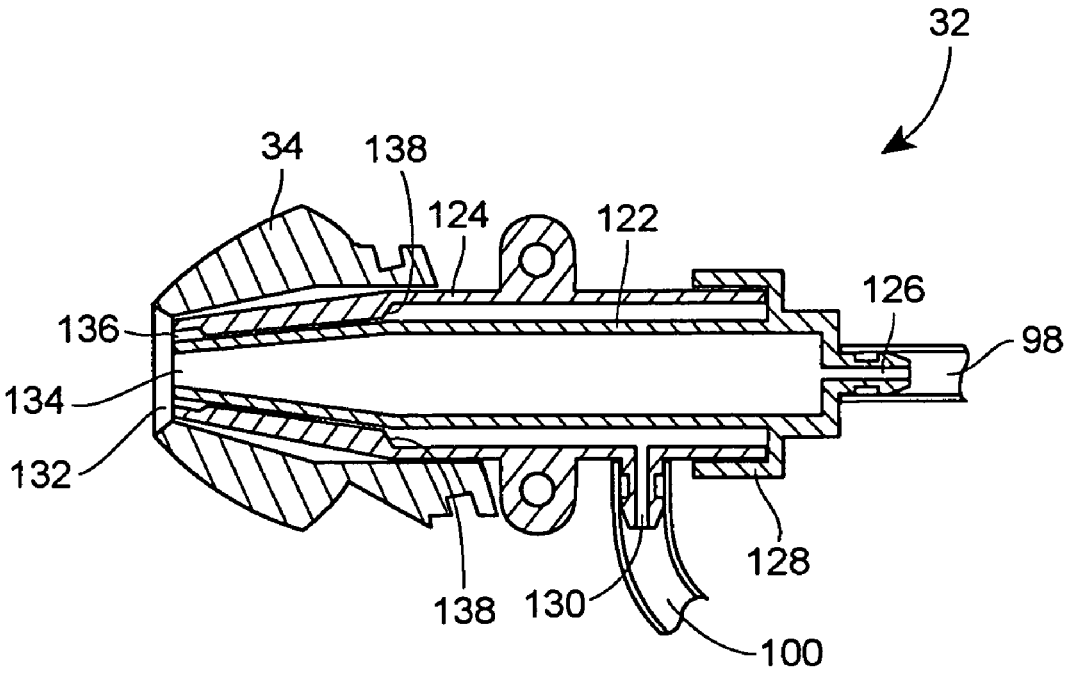
FIG. 11 is a side cross-sectional view through line 11-11 of FIG. 3 of an embodiment of a mixing nozzle in accordance with the invention.
Figure 12:
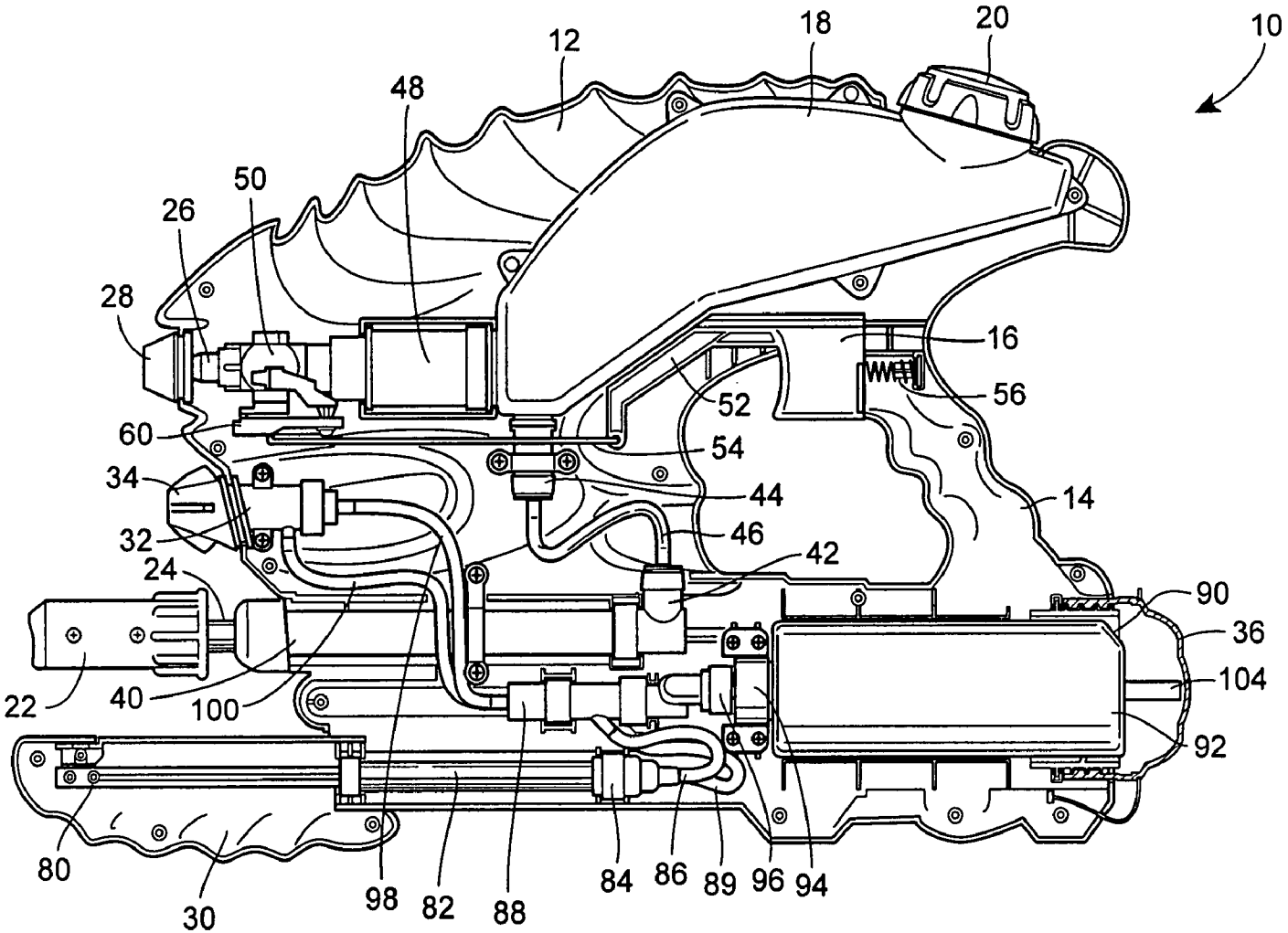
FIG. 12 is a side view of the toy water gun as illustrated in FIG. 4 with second pump handle in an extended position.

Referring to FIG. 11, an embodiment of the mixing nozzle 32 and the mixing nozzle housing 34 are illustrated in greater detail. The mixing nozzle 32 may include an inner nozzle 122 disposed within an outer nozzle 124 such that the nozzles 122, 124 are coaxially aligned. The inner nozzle 122 may include an inlet 126 configured to be received by the conduit 98 and to form a substantially air-tight and water-tight seal. The inner nozzle 122 may further include a collar 128 configured to receive one end of the outer nozzle 124, and to engage the end of the outer nozzle 124 to form an air-tight and water-tight seal. Alternatively, the end of the outer nozzle 124 may be attached to the collar 128 by an adhesive forming such a seal therebetween. The collar 128 may be further configured to align the outer nozzle 124 coaxially with the inner nozzle 122 when the end of the outer nozzle 124 is received therein. The outer nozzle 124 may include an inlet 130 configured to be received into the end of the conduit 102 and to form a substantially air-tight and water-tight seal therebetween. Proximate a discharge opening 132 of the mixing nozzle housing 34, an inner opening or outlet 134 of the inner nozzle 122 may be aligned concentrically with an outer opening or outlet 136 of the outer nozzle 124. In the illustrated embodiment, the inner nozzle 122 tapers inwardly toward the inner outlet 134, and the outer nozzle 124 tapers inwardly toward the outer outlet 136 such that liquid being discharged from the outer nozzle 124 may be projected inwardly toward the longitudinal axis of the mixing nozzle 32 and into engagement with the liquid being discharged from the inner outlet 134 of the inner nozzle 122. In order to properly align the outlets 134, 136 when the mixing nozzle 32 is assembled, one or more flanges 138 may extend inwardly from the inner surface of the outer nozzle 124 and engage the outer surface of the inner nozzle 122, with the flanges 138 being spaced about the inner surface of the outer nozzle 124 so that the second fluid may flow around the flanges 138 to the second outlet 136. Alternatively, the flanges 138 may extend outwardly from the outer surface of the inner nozzle 122 and engage the inner surface of the outer nozzle 124 to align the outlets 134, 136.

The first and second liquids are pumped into the mixing nozzle 32 through the conduits 98, 102, respectively, when the second discharge mechanism is actuated in a manner more fully described below. The first liquid passes through the inner nozzle 122 toward the inner outlet 134, and the second liquid enters the outer nozzle 124 at the inlet 130, surrounds the inner nozzle 122, and is forced through the outer outlet 136. As the first liquid is discharged from the inner outlet 134 and the second liquid is discharged through the outer outlet 136, the discharged second liquid engages the discharged first liquid, thereby mixing the liquids at a point external to the mixing nozzle 32 and projecting the mixed liquids outwardly from the toy gun 10. Configured in this manner, the liquids are maintained in separate flow paths until the liquids are discharged out of the mixing nozzle 32.

The operation of the second discharge mechanism will now be described with reference to FIGS. 4 and 9-12. In preparation for dispensing the liquids via the second discharge mechanism, the tanks 92 may be filled with the corresponding liquids, and the canister 90 may be inserted into the housing 12 with the endcaps 94 receiving and sealingly engaging the corresponding inlet stems 106 and O-rings 108. When the canister 90 is in place with the cover 36 reattached to the housing 12, the second discharge mechanism may be primed by pulling the second pump handle 30 outwardly toward the extended position shown in FIG. 12. As the second pump handle 30 is pulled outwardly, the pistons within the second cylinders 82 move with the second pump handle 30 and decrease the pressure within the two fluid flow paths of the second discharge mechanism. The pressure drops cause the liquids to be drawn from the tanks 92 through the corresponding inlet stems 106 and into the intermediate reservoirs 88 and second cylinders 82. At the same time, to compensate for the decrease in volume in the tanks 92 as the liquids are drawn out, air is drawn into the tanks 92 through the one-way vents 112, thereby equalizing the pressure within the tanks 92. The one-way valves in the connectors 96 allow the liquids to flow into the intermediate reservoir 88, and then close to prevent the liquids from flowing in the reverse direction and reentering the tanks 92. Once the second discharge mechanism is primed, the liquids may be discharged through the mixing nozzle 32 by forcing the second pump handle 30 inwardly to move the pistons within the second cylinders 82 through a compression stroke. As the pressure is increased in the fluid flow paths during the compression stroke, the liquids are forced through the conduits 98, 102 and into the inner nozzle 122 and outer nozzle 124, respectively, and out of the mixing nozzle 32 through the inner outlet 134 and outer outlet 136, respectively. Configured in this way, the second discharge mechanism may discharge the liquids through the mixing nozzle 32 each time the second pump handle 30 is cycled. Depending on the capacity of the second cylinders 82 and the tanks 92, the second pump handle 30 may be cycled multiple times, with the liquids being discharged from the mixing nozzle 32 each time the second pump handle 30 moves to cause compression strokes of the pistons within the second cylinders 82. Moreover, the sizes of the nozzles 122, 124 and the outlets 134, 136, respectively, may be configured such that the particular fluids being mixed are mixed in the appropriate ratios to yield the desired compound.

In one embodiment, the second discharge mechanism of the toy gun 10 may be configured to discharge two liquids that, when mixed, may form a slimy gel compound. The characteristics of the gel compound may be such that the gel compound may not be easily discharged from a toy gun and, if done so, may tend to clog the fluid flow path and/or the spray nozzle of the toy gun. However, it may be desirable to discharge the gel compound from the toy gun 10, with the gel compound being projected in a string when the fluids mix during discharge from the mixing nozzle 32. The gel compound may be a conventional two-part alginate composition, with a first solution (alginate solution) that may comprise sodium alginate and water as the main ingredients, and a second solution (alginate curing solution) that may comprise calcium chloride and water as the main ingredients. The alginate curing solution may cure the alginate solution when the first and second discharge streams intersect. In one particular embodiment, the first solution may comprise the sodium alginate Manugel® DH (approximately 2.00%), such as that commercially available from International Specialty Products, propylene glycol (approximately 6.00%), the preservative chloroallyl methenamine chloride (CASRN 51229-78-8) (approximately 0.20%), wax-18 signal green colorant (approximately 0.11%), such as that commercially available from DayGlo® Color Corp., and distilled water (approximately 91.69%). Further, the second solution may comprise calcium chloride (approximately 3.00%), propylene glycol (approximately 6.00%), chloroallyl methenamine chloride (approximately 0.20%), Cellosize® hydroxyethyl cellulose ER-30M (approximately 0.70%), wax-17N Saturn yellow colorant (approximately 0.33%), such as that commercially available from DayGlo® Color Corp., and distilled water (approximately 89.77%).

The first tank 92 may be filled with the first solution and the second tank 92 may be filled with the second solution. When the second pump handle 30 of the second discharge mechanism is cycled, the first and second solutions may flow through the respective fluid flow paths to the mixing nozzle 32 and be discharged from the inner nozzle 122 and outer nozzle 124, respectively, such that the solutions mix as discussed above to form the desired slimy gel alginate composition. In developing the formulations of the solutions to be mixed, it may be necessary to match the properties of the solutions so that they mix properly to form the desired end product upon discharge. For example, the above-described solutions were formulated such that the viscosities of the solutions were low and similar. Manugel® DH is a low molecular weight algin that flows more easily before and after gelation with calcium. Low viscosity maximizes the discharge distance and minimizes the pressure required to discharge the solutions. If the viscosities of the solutions are not similar, then the lower viscosity solution may blow by the higher viscosity solution and discharge from the toy gun 10 with minimal mixing.

Figure 13:
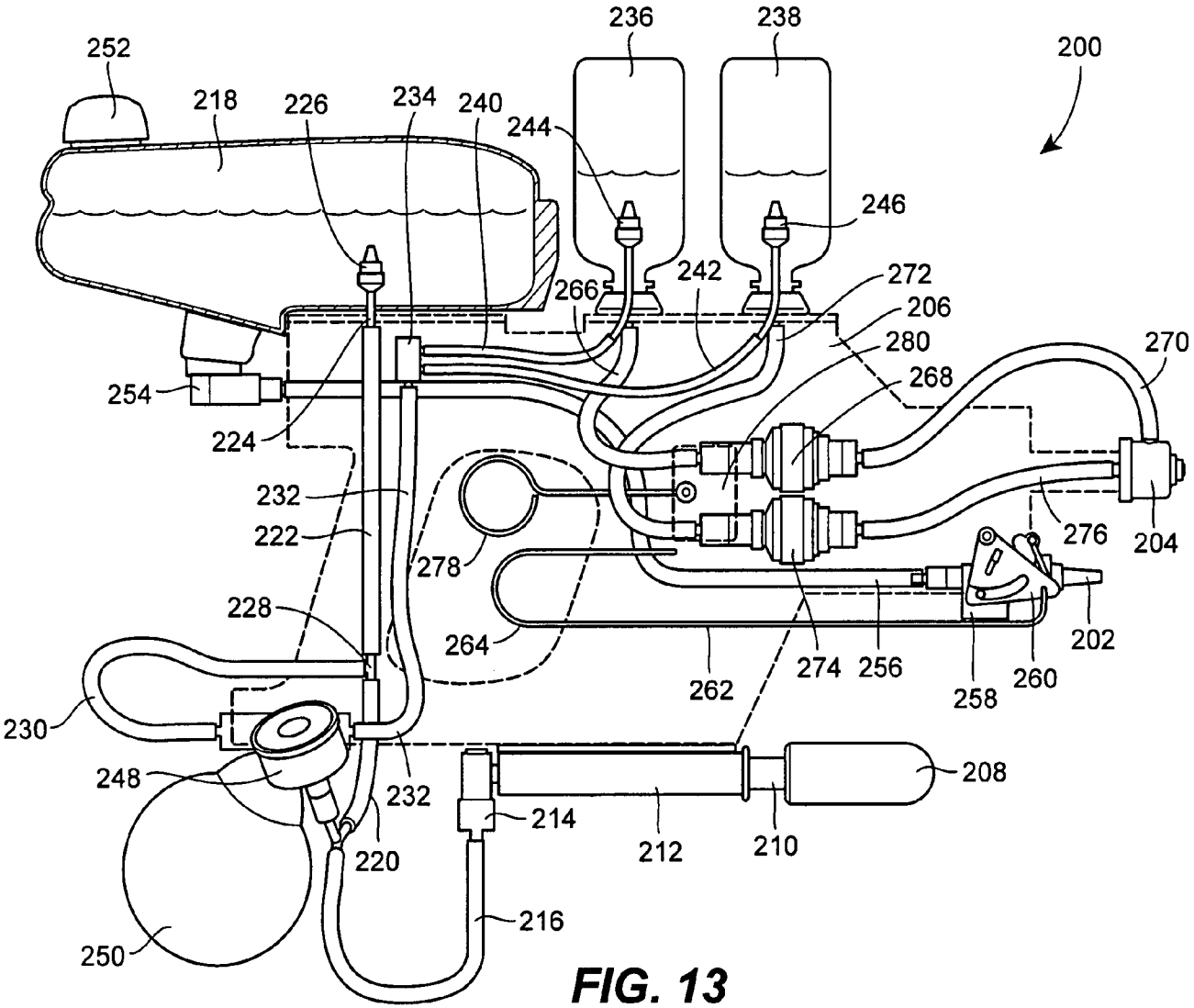
FIG. 13 is a schematic representation of an alternative embodiment of a toy water gun having a spray nozzle and a mixing nozzle.

While the toy gun 10 discussed above may include separate discharge mechanisms that are individually pressurized, other configurations of toy guns are contemplated wherein liquids are discharged from the toy gun and mixed as the liquids are discharged from a mixing nozzle. FIG. 13 schematically illustrates an alternative embodiment of a toy gun 200 having a single pressurization mechanism for pressurizing both a discharge mechanism for a spray nozzle 202 and a discharge mechanism for a mixing nozzle 204. The components of the toy gun 200 may be disposed within a support structure 206 such as a housing similar to the housing 12 described above.

The pressurization mechanism of the toy gun 200 may include a pump handle 208 that may be attached to a stem 210 that may in turn be attached to a piston (not shown) disposed within a cylinder 212 that is configured to compress air within the toy gun 200 and pressurize the discharge mechanisms when the pump handle 208 is moved from an extended position to the illustrated inward position. The cylinder 212 may include a connector 214 having an outlet connected to a conduit 216 with a substantially air-tight and water-tight seal. The cylinder 212 may be placed in fluid communication with a reservoir 218 of the first discharge mechanism by conduits 216, 220, 222, with an end of the conduit 222 being connected to an inlet 224 of the reservoir 218. The connector 214 may include a one-way valve (not shown) that may allow air to pass from the cylinder 212 to the conduits 216, 220, 222 when the pump handle 208 is pushed towards the inward position in a compression stroke, and may prevent air from flowing in the reverse direction and into the cylinder 212. Similarly, the inlet of the reservoir 218 may include a check valve 226 that may allow air to pass from the conduits 216, 220, 222 into the reservoir 218 to pressurize the first discharge mechanism while preventing air and liquid in the reservoir 218 from flowing in the reverse direction and into the conduits 216, 220, 222.

To provide pressurized air from the cylinder 212 to the second discharge mechanism, a T-shaped connector 228 may be disposed between the conduits 220, 222, and may have a conduit 230 connected thereto to provide a fluid flow path to the second discharge mechanism. Conduits 230, 232 may place the cylinder 212 in fluid communication with an inlet of a connector 234, which may in turn include two outlets placed in fluid communication with the inlets of tanks 236, 238 of the second discharge mechanism by conduits 240, 242, respectively. The inlets of the tanks 236, 238 may include check valves 244, 246 that may allow air to pass from the conduits 240, 242 into the tanks 236, 238 to pressurize the second discharge mechanism while preventing air and liquid in the tanks 236, 238 from flowing in the reverse direction and into the conduits 240, 242. If desired, the pressurization mechanism may include additional components. For example, the pressurization mechanism may include a pressure gauge 248 disposed between the conduits 216, 220 and providing a visual indication for a user of the pressure level within the pressurization mechanism and discharge mechanisms. Further, the pressurization mechanism may include a pressure tank 250 disposed between the conduits 230, 232 and providing a reservoir for pressurized air when the reservoir 218 and tanks 236, 238 are full of liquid and, consequently, will not allow air to be pumped in through the check valves 226, 244, 246, respectively. Air accumulates within the pressure tank 250 and subsequently flows into the reservoir 218 and/or tanks 236, 238 when the liquids are discharged by the discharge mechanisms. Of course, the embodiment of the pressurization mechanism illustrated herein is exemplary. Other pressurization mechanisms and configurations for simultaneously pressurizing the discharge mechanism will be apparent to those skilled in the art and are contemplated by the inventors as having use and being implemented in a toy gun in accordance with the invention.

The remaining components of the first discharge mechanism of the toy gun 200 are similar to the corresponding components of the first discharge mechanism of the toy gun 10 discussed above. The reservoir 218 may be filled with liquid by removing a fill cap 252, and an outlet of the reservoir 218 may include a connector 254 forming an air-tight and water-tight seal with one end of a conduit 256. The other end of the conduit 256 may be connected to an inlet of a snap action ball valve assembly 258 that may be similar to the ball valve assembly 50, and that may have the spray nozzle 202 disposed at an outlet thereof such that the reservoir 218 and spray nozzle 202 may be placed in fluid communication by the connector 254, conduit 256 and ball valve assembly 258. The ball valve assembly 258 may include a trip assembly 260 similar to the trip assembly 60 described above for causing the ball valve assembly 258 to open with a snap action to discharge a burst of pressurized liquid through the spray nozzle 202. To actuate the trip assembly 260, a connector arm 262 may be attached thereto and form a trigger 264 that may be pulled rearwardly by a user to cause the trip assembly 260 to snap the ball valve assembly 258 to the open position as described above. A spring (not shown) may engage the connector arm 256 or the trip assembly 260 to bias the trigger 264 and trip assembly 260 toward the normal position with the ball valve assembly 258 closed.

As with the second discharge mechanism of the toy gun 10, the second discharge mechanism of the toy gun 200 may include separate fluid flow paths for the liquids in the tanks 236, 238 to flow to the mixing nozzle 204. The first fluid flow path from the tank 236 includes a conduit 266 connecting an outlet of the tank 236 to an inlet of a first release valve 268, and a conduit 270 connecting an outlet of the release valve 268 to a first inlet of the mixing nozzle 204. Similarly, the second fluid flow path from the tank 238 includes a conduit 272 connecting an outlet of the tank 238 to an inlet of a second release valve 274, and a conduit 276 connecting an outlet of the release valve 274 to a first inlet of the mixing nozzle 204. The second discharge mechanism may further include a trigger 278 operatively coupled to the release valves 268, 274 by a connector bracket 280 such that rearward movement of the trigger 278 and, correspondingly, the connector bracket 280 may open the release valves 268, 274 to place the tanks 236, 238 in fluid communication with the mixing nozzle 204 and allow the liquids in the tanks 236, 238 to flow through the respective fluid flow paths to the mixing nozzle 204. The release valves 268, 274 may be any type of valve commonly known to those skilled in the art for use in pressurized squirt guns to control the discharge of pressurized liquid. Further, a spring or springs (not shown) may engage the trigger 278, connector bracket 280 and/or release valves 268, 274 to bias the trigger 278 and release valves 268, 274 toward the normal closed position.

Figure 14:
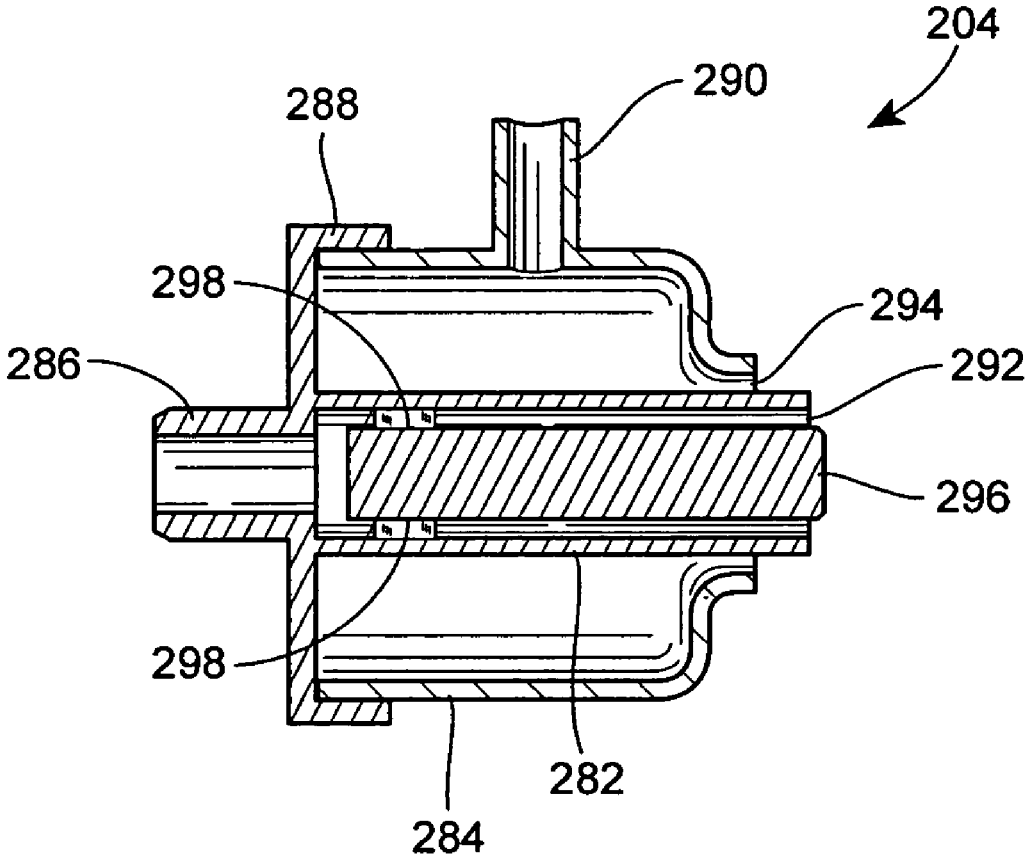
FIG. 14 is a side cross-sectional view of an alternate embodiment of a mixing nozzle in accordance with the invention.

The alternative embodiment of the mixing nozzle 204 is illustrated in FIG. 14. The mixing nozzle 204 is similar to the mixing nozzle 32 of FIG. 11 and may include an inner nozzle 282 disposed within an outer nozzle 124 such that the nozzles 122 and 124 are coaxially aligned. The inner nozzle 282 may include an inlet 286 configured to be received by the conduit 276 and to form a substantially air-tight and water-tight seal. The inner nozzle 282 may further include a collar 288 configured to receive one end of the outer nozzle 284, and to engage the end of the outer nozzle 284 to form an air-tight and water-tight seal. Alternatively, the end of the outer nozzle 284 may be attached to the collar 288 by an adhesive forming such a seal therebetween. The collar 288 may be further configured to align the outer nozzle 284 coaxially with the inner nozzle 282 when the end of the outer nozzle 284 is received therein. The outer nozzle 284 may include an inlet 290 configured to be received into the end of the conduit 270 and to form a substantially air-tight and water-tight seal therebetween. At the discharge end of the mixing nozzle 204, an inner opening 292 of the inner nozzle 282 may be aligned concentrically with an outer opening 294 of the outer nozzle 284. In the illustrated embodiment, the inner nozzle 282 may have an inner cylinder 296 disposed therein and connected to an inner surface of the inner nozzle 282 by fins or baffles 298 such that the inner cylinder 296 may be substantially coaxially aligned with the inner nozzle 282 and outer nozzle 284. The cylinder 296 may also be aligned such that the cylinder 296 at least partially extends through the inner opening 292 of the inner nozzle 282, thereby reducing the area of the inner opening 292 and causing the discharge of a tube of liquid.

The first and second liquids are pumped into the mixing nozzle 204 through the conduits 270, 276, respectively, when the second discharge mechanism is actuated by pulling the trigger 278 to open the release valves 268, 274, respectively. The first liquid enters the outer nozzle 284 at the inlet 290, surrounds the inner nozzle 282, and is forced through the outer opening 294 as a discharged outer tube of liquid. At the same time, the second liquid enters the inner nozzle 282 at the inlet 286, and passes around the inner cylinder 296 and through the inner opening 292 as a discharged inner tube of liquid. As the tubes of liquid are discharged, inner tube of liquid mixes with the outer tube of liquid at a point external to the mixing nozzle 204, and the mixed liquids are projected outwardly from the toy gun 200. Configured in this manner, the liquids are maintained in separate flow paths until the liquids are discharged out of the mixing nozzle 204. Moreover, depending on the liquids to be mixed and the desired compound to be formed thereby, dimensions of the inner opening 292, the outer opening 294 and the inner cylinder 296 may be adjust to achieve the necessary fluid flow rates and volumes for the liquids to be mixed in the proper ratios to form the desired mixture or compound with the desired characteristics.

The embodiments illustrated herein are exemplary, and other configurations of toy guns wherein two or more liquids are stored in tanks or reservoirs, travel through separate fluid flow paths within the toy gun, and are mixed as the liquids are discharged from the toy gun are contemplated by the inventors and will be apparent to those skilled in the art. The toy guns may be configured to discharge the liquids to be mixed, and may not necessarily include additional pressurization and/or discharge mechanisms for discharging an additional liquid. Moreover, other pressurization and discharge mechanisms, and configurations of fluid flow paths for toy guns are known in the art and are contemplated as having use discharging and mixing liquids. For example, the pressurization mechanism may be another type of manual pressurization mechanism, or may be an electro-mechanical pump mechanism. As a further alternative, pressurized liquids may be provided by external sources. Still further, other discharge mechanisms may be used, including other types of actuation mechanisms and valves to control the flow and discharge of the pressurized liquids.

Alternative configurations of nozzles are contemplated wherein the liquids are mixed as they are discharged from the toy gun. While the two embodiments illustrated herein disclose mixing nozzles having coaxially aligned inner and outer nozzles, the nozzles may have other relative dispositions wherein the discharge liquids are mixed at the time they are discharged. In one alternate embodiment, the nozzles for the liquids may be disposed side-by-side or adjacent to one another, with one or both of the nozzles being oriented such that the discharged streams of liquids engage each other to mix the liquids as they are discharged from the nozzles. Depending on the compound to be created as the liquids are mixed, and the constituent liquids to be mixed, the toy gun may include reservoirs or tanks, fluid flow paths and discharge nozzles for more than two liquids. Still further, the nozzles for each of the liquids may or may not be connected or otherwise joined by a single housing and may instead be disposed proximate to and aligned with each other solely by the housing of the toy gun. Other configurations of multiple nozzles for mixing liquids discharged from a toy gun will be apparent to those skilled in the art and are contemplated as having use in a toy gun in accordance with the present invention.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy gun for discharging and mixing a first liquid and a second liquid, comprising:

a first tank configured to receive the first liquid;

a second tank configured to receive the second liquid;

a first nozzle having a first inlet in fluid communication with the first tank and a first outlet;

a second nozzle having a second inlet in fluid communication with second tank and a second outlet; and a pressurization mechanism in fluid communication with the first and the second tanks and the first and the second nozzles, wherein the pressurization mechanism provides pressure to cause the first liquid from the first tank to be discharged from the toy gun at the first outlet of the first nozzle in a first discharge stream, and to cause the second liquid from the second tank to be discharged from the toy gun at the second outlet of the second nozzle in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the first nozzle and the second nozzle are coaxially aligned with the first outlet being disposed concentrically with the second outlet, and with the first outlet being disposed within the second outlet.

2. A toy gun in accordance with claim 1, wherein the first nozzle includes a cylinder connected to an inner surface of the first nozzle, and wherein the cylinder is coaxially aligned with the first nozzle and extends at least partially through the first outlet.

3. A toy gun in accordance with claim 1, comprising a third tank configured to receive a third liquid;

a third nozzle having a third inlet in fluid communication with the third tank and a third outlet, wherein the pressurization mechanism is in fluid communication with the third tank and the third nozzle, and wherein the pressurization mechanism provides pressure to cause the third liquid from the third tank to be discharged from the third outlet of the third nozzle in a third discharge stream.

4. A toy gun in accordance with claim 3, comprising a third valve disposed between the third tank and the third nozzle, the third valve having a closed position wherein the third tank is not in fluid communication with the third nozzle, and an open position wherein the third tank is in fluid communication with the third nozzle.

5. A toy gun for discharging and mixing a first liquid and a second liquid, comprising:

a first tank configured to receive the first liquid;

a second tank configured to receive the second liquid;

a first nozzle having a first inlet in fluid communication with the first tank and a first outlet;

a second nozzle having a second inlet in fluid communication with second tank and a second outlet; and a pressurization mechanism in fluid communication with the first and the second tanks and the first and the second nozzles, wherein the pressurization mechanism provides pressure to cause the first liquid from the first tank to be discharged from the toy gun at the first outlet of the first nozzle in a first discharge stream, and to cause the second liquid from the second tank to be discharged from the toy gun at the second outlet of the second nozzle in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the pressurization mechanism comprises a first cylinder having a first piston disposed therein in fluid communication with the first tank and the first nozzle, and a second cylinder having a second piston disposed therein in fluid communication with the second tank and the second nozzle, wherein movement of the first and second pistons in expansion strokes causes the first and second liquids to be drawn out of the first and second tanks, respectively, and movement of the first and second pistons in compression strokes cause the first and second liquids to be discharged from the first and second nozzles, respectively.

6. A toy gun for discharging and mixing a first liquid and a second liquid, comprising:

a first tank configured to receive the first liquid;

a second tank configured to receive the second liquid;

a first nozzle having a first inlet in fluid communication with the first tank and a first outlet:

a second nozzle having a second inlet in fluid communication with second tank and a second outlet;

a first valve disposed between the first tank and the first nozzle, the first valve having a closed position wherein the first tank is not in fluid communication with the first nozzle, and an open position wherein the first tank is in fluid communication with the first nozzle;

a second valve disposed between the second tank and the second nozzle, the second valve having closed position wherein the second tank is not in fluid communication with the second nozzle, and an open position wherein the second tank is in fluid communication with the second nozzle; and a pressurization mechanism in fluid communication with the first and the second tanks and the first and the second nozzles, wherein the pressurization mechanism provides pressure to cause the first liquid from the first tank to be discharged from the toy gun at the first outlet of the first nozzle in a first discharge stream, and to cause the second liquid from the second tank to be discharged from the toy gun at the second outlet of the second nozzle in a second discharge stream, wherein the first nozzle and the second nozzle are oriented relative to each other such that the first discharge stream and the second discharge stream engage each other at a position external to the toy gun after being discharged from the first outlet and second outlet, respectively.

7. A toy gun in accordance with claim 6, comprising a trigger operatively coupled to the first valve and the second valve, wherein the first valve and the second valve are simultaneously moved to their open positions when the trigger moves from a normal position to a discharge position.

8. A toy gun for discharging and mixing a first liquid and a second liquid, comprising:

a first tank configured to receive the first liquid;

a second tank configured to receive the second liquid;

a first nozzle having a first inlet in fluid communication with the first tank and a first outlet;

a second nozzle having a second inlet in fluid communication with second tank and a second outlet;

a pressurization mechanism in fluid communication with the first and the second tanks and the first and the second nozzles, wherein the pressurization mechanism provides pressure to cause the first liquid from the first tank to be discharged from the toy gun at the first outlet of the first nozzle in a first discharge stream, and to cause the second liquid from the second tank to be discharged from the toy gun at the second outlet of the second nozzle in a second discharge stream;

a third tank configured to receive a third liquid;

a third nozzle having a third inlet in fluid communication with the third tank and a third outlet; and a second pressurization mechanism in fluid communication with the third tank and the third nozzle, wherein the second pressurization mechanism provides pressure to cause the third liquid from the third tank to be discharged from the third outlet of the third nozzle in a third discharge stream, wherein the first nozzle and the second nozzle are oriented relative to each other such that the first discharge stream and the second discharge stream engage each other at a position external to the toy gun after being discharged from the first outlet and second outlet, respectively.

9. A toy gun in accordance with claim 8, comprising a third valve disposed between the third tank and the third nozzle, the third valve having a closed position wherein the third tank is not in fluid communication with the third nozzle, and an open position wherein the third tank is in fluid communication with the third nozzle.

10. A toy gun for discharging and mixing a first liquid and a second liquid, comprising:

a first tank configured to receive the first liquid;

a second tank configured to receive the second liquid;

a first nozzle having a first inlet in fluid communication with the first tank and a first outlet;

a second nozzle having a second inlet in fluid communication with second tank and a second outlet; and a pressurization mechanism in fluid communication with the first and the second tanks and the first and the second nozzles, wherein the pressurization mechanism provides pressure to cause the first liquid from the first tank to be discharged from the toy gun at the first outlet of the first nozzle in a first discharge stream, and to cause the second liquid from the second tank to be discharged from the toy gun at the second outlet of the second nozzle in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the first liquid comprises an alginate solution and the second liquid comprises an alginate curing solution for curing the alginate solution when the first discharge stream and the second discharge stream engage each other.

11. A mixing nozzle for a toy gun for discharging and mixing a first liquid and a second liquid, comprising:

a first nozzle having a first inlet and a first outlet, wherein the first inlet is configured to receive the first liquid from a first pressurized source of the first liquid, and the first outlet is configured to discharge the pressurized first liquid from the toy gun in a first discharge stream; and a second nozzle having a second inlet and a second outlet, wherein the second inlet is configured to receive the second liquid from a second pressurized source of the second liquid, and the second outlet is configured to discharge the pressurized second liquid from the toy gun in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the first nozzle and the second nozzle are coaxially aligned with the first outlet being disposed concentric with the second outlet, and with the first outlet being disposed within the second outlet.

12. A mixing nozzle in accordance with claim 11, wherein an inner surface of the second nozzle tapers inwardly as the inner surface progresses toward the second outlet.

13. A mixing nozzle in accordance with claim 12, wherein the first nozzle tapers inwardly as the first nozzle progresses toward the first outlet.

14. A mixing nozzle in accordance with claim 11, wherein the first nozzle includes a cylinder connected to an inner surface of the first nozzle, and wherein the cylinder is coaxially aligned with the first nozzle and extends at least partially through the first outlet.

15. A mixing nozzle for a toy gun for discharging and mixing a first liquid and a second liquid, comprising:

a first nozzle having a first inlet and a first outlet, wherein the first inlet is configured to receive the first liquid from a first pressurized source of the first liquid, and the first outlet is configured to discharge the pressurized first liquid from the toy gun in a first discharge stream; and a second nozzle having a second inlet and a second outlet, wherein the second inlet is configured to receive the second liquid from a second pressurized source of the second liquid, and the second outlet is configured to discharge the pressurized second liquid from the toy gun in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the first nozzle comprises a collar disposed at an end of the first nozzle opposite the first outlet, and wherein the collar receives an open end of the second nozzle disposed at an end of the second nozzle opposite the second outlet.

16. A mixing nozzle in accordance with claim 15, wherein the collar of the first nozzle engages the open end of the second nozzle to coaxially align the first and the second nozzles.

17. A mixing nozzle for a toy gun for discharging and mixing a first liquid and a second liquid, comprising:

a first nozzle having a first inlet and a first outlet, wherein the first inlet is configured to receive the first liquid from a first pressurized source of the first liquid, and the first outlet is configured to discharge the pressurized first liquid from the toy gun in a first discharge stream; and a second nozzle having a second inlet and a second outlet, wherein the second inlet is configured to receive the second liquid from a second pressurized source of the second liquid, and the second outlet is configured to discharge the pressurized second liquid from the toy gun in a second discharge stream, wherein the first nozzle and the second nozzle are oriented relative to each other such that the first discharge stream and the second discharge stream engage each other at a position external to the toy gun after being discharged from the first outlet and second outlet, respectively, and wherein the first liquid comprises an alginate solution and the second liquid comprises an alginate curing solution for curing the alginate solution when the first discharge stream and the second discharge stream engage each other.

18. A toy gun for discharging and mixing a first liquid and a second liquid, and for discharging a third liquid, comprising:

a first tank configured to receive the first liquid;

a second tank configured to receive the second liquid;

a first nozzle having a first inlet in fluid communication with the first tank and a first outlet;

a second nozzle having a second inlet in fluid communication with second tank and a second outlet;

a first pressurization mechanism in fluid communication with the first and the second tanks and the first and the second nozzles, wherein the first pressurization mechanism provides pressure to cause the first liquid from the first tank to be discharged from the first outlet of the first nozzle in a first discharge stream, and to cause the second liquid from the second tank to be discharged from the second outlet of the second nozzle in a second discharge stream, and wherein the first nozzle and the second nozzle are oriented relative to each other such that the first discharge stream and the second discharge stream engage each other after being discharged from the first outlet and second outlet, respectively;

a third tank configured to receive the third liquid;

a third nozzle having a third inlet in fluid communication with the third tank and a third outlet; and a second pressurization mechanism in fluid communication with the third tank and the third nozzle, wherein the second pressurization mechanism provides pressure to cause the third liquid from the third tank to be discharged from the third outlet of the third nozzle in a third discharge stream.

19. A toy gun in accordance with claim 18, wherein the first nozzle and the second nozzle are coaxially aligned with the first outlet being disposed concentrically with the second outlet, and with the first outlet being disposed within the second outlet.

20. A toy gun in accordance with claim 18, wherein the first nozzle includes a cylinder connected to an inner surface of the first nozzle, and wherein the cylinder is coaxially aligned with the first nozzle and extends at least partially through the first outlet.

21. A toy gun in accordance with claim 18, wherein the first nozzle and the second nozzle are disposed adjacent to one another and oriented so that the first discharge stream engages the second discharge stream.

22. A toy gun in accordance with claim 18, wherein the first pressurization mechanism comprises a first cylinder having a first piston disposed therein in fluid communication with the first tank and the first nozzle, and a second cylinder having a second piston disposed therein in fluid communication with the second tank and the second nozzle, wherein movement of the first and second pistons in expansion strokes causes the first and second liquids to be drawn out of the first and second tanks, respectively, and movement of the first and second pistons in compression strokes cause the first and second liquids to be discharged from the first and second nozzles, respectively.

23. A toy gun in accordance with claim 22, comprising:

a third valve disposed between the third tank and the third nozzle, the third valve having a closed position wherein the third tank is not in fluid communication with the third nozzle, and an open position wherein the third tank is in fluid communication with the third nozzle, wherein the second pressurization mechanism comprises a third cylinder having a third piston disposed therein in fluid communication with the third tank and the third nozzle, wherein movement of the third piston in a compression stroke when the third valve is in the closed position increases the pressure in the third tank.

24. A toy gun in accordance with claim 18, comprising:

a first valve disposed between the first tank and the first nozzle, the first valve having a closed position wherein the first tank is not in fluid communication with the first nozzle, and an open position wherein the first tank is in fluid communication with the first nozzle;

a second valve disposed between the second tank and the second nozzle, the second valve having closed position wherein the second tank is not in fluid communication with the second nozzle, and an open position wherein the second tank is in fluid communication with the second nozzle; and a first trigger operatively coupled to the first valve and the second valve, wherein the first valve and the second valve are simultaneously moved to their open positions when the trigger moves from a normal position to a discharge position.

25. A toy gun in accordance with claim 24, comprising a third valve disposed between the third tank and the third nozzle, the third valve having a closed position wherein the third tank is not in fluid communication with the third nozzle, and an open position wherein the third tank is in fluid communication with the third nozzle; and a second trigger operatively coupled to the third valve, wherein the third valve moves to the open position when the second trigger moves from a normal position to a discharge position.

26. A toy gun in accordance with claim 18, wherein the first pressurization mechanism and the second pressurization mechanism are the same pressurization mechanism.

27. A toy gun in accordance with claim 26, wherein the same pressurization mechanism simultaneously provides pressure to the first, second and third tanks.

28. A toy gun in accordance with claim 18, wherein the first liquid comprises an alginate solution and the second liquid comprises an alginate curing solution for curing the alginate solution when the first discharge stream and the second discharge stream engage each other.

29. A method for discharging and mixing a first liquid and a second liquid from a toy gun, comprising:

providing a first nozzle for discharging the first liquid from the toy gun and a second nozzle for discharging the second liquid from the toy gun;

aligning the first nozzle and the second nozzle such that a discharged stream of the first liquid from the first nozzle and a discharged stream of the second liquid from the second nozzle engage each other at a position external to the toy gun after being discharged from the first nozzle and second nozzle, respectively;

coaxially aligning the first nozzle and the second nozzle with a first outlet of the first nozzle being disposed concentrically with a second outlet of the second nozzle, and with the first outlet being disposed within the second outlet;

storing a quantity of the first liquid and a quantity of the second liquid in the toy gun; and simultaneously supplying the stored first liquid to the first nozzle and the stored second liquid to the second nozzle under pressure for discharge from the toy gun at the first and second nozzles, respectively, as the discharged streams of liquid.

30. A method in accordance with claim 29, comprising connecting a cylinder to an inner surface of the first nozzle, wherein the cylinder is coaxially aligned with the first nozzle and extends at least partially through a first outlet of the first nozzle.

31. A method for discharging and mixing a first liquid and a second liquid from a toy gun, comprising:

providing a first nozzle for discharging the first liquid from the toy gun and a second nozzle for discharging the second liquid from the toy gun;

aligning the first nozzle and the second nozzle such that a discharged stream of the first liquid from the first nozzle and a discharged stream of the second liquid from the second nozzle engage each other at a position external to the toy gun after being discharged from the first nozzle and second nozzle, respectively;

storing a quantity of the first liquid and a quantity of the second liquid in the toy gun; and simultaneously supplying the stored first liquid to the first nozzle and the stored second liquid to the second nozzle under pressure for discharge from the toy gun at the first and second nozzles, respectively, as the discharged streams of liquid, wherein the first liquid comprises an alginate solution and the second liquid comprises an alginate curing solution for curing the alginate solution when the discharge stream of the first liquid and the discharge stream of the second liquid engage each other.

32. A method in accordance with claim 31, wherein the alginate solution comprises approximately 2.00% sodium alginate, approximately 6.00% propylene glycol, approximately 0.20% preservative, approximately 0.11% green colorant, and approximately 91.69% distilled water, and wherein the alginate curing solution comprises approximately 3.00% calcium chloride, approximately 6.00% propylene glycol, approximately 0.20% preservative, approximately 0.70% hydroxyethyl cellulose, approximately 0.33% yellow colorant, and approximately 89.77% distilled water.

* * * * *